US007461766B2

(12) United States Patent
Miyata et al.

(10) Patent No.: US 7,461,766 B2
(45) Date of Patent: Dec. 9, 2008

(54) COMBUSTION POWER TOOL

(75) Inventors: Kenichi Miyata, Anjo (JP); Jiro Oda, Anjo (JP)

(73) Assignee: Makita Corporation, Anjo-shi (JP)

( * ) Notice: Subject to any disclaimer, the term of this patent is extended or adjusted under 35 U.S.C. 154(b) by 0 days.

(21) Appl. No.: 10/984,349

(22) Filed: Nov. 8, 2004

(65) Prior Publication Data

US 2005/0098123 A1 May 12, 2005

(30) Foreign Application Priority Data

Nov. 7, 2003 (JP) ..... 2003-377872
Nov. 17, 2003 (JP) ..... 2003-386436

(51) Int. Cl.
*B25C 1/08* (2006.01)

(52) U.S. Cl. ..... 227/10; 227/9; 123/46 SC

(58) Field of Classification Search ..... 227/8, 227/9, 10; 123/46 R, 46 SC
See application file for complete search history.

(56) References Cited

U.S. PATENT DOCUMENTS

| | | | | | |
|---|---|---|---|---|---|
| 2,898,893 | A | * | 8/1959 | Rohrer et al. | 60/633 |
| 4,218,888 | A | * | 8/1980 | Jayne | 60/632 |
| 4,292,021 | A | * | 9/1981 | Miyagawa | 431/13 |
| 4,403,722 | A | | 9/1983 | Nikolich | |
| 4,483,280 | A | | 11/1984 | Nikolich | |
| 4,483,474 | A | | 11/1984 | Nikolich | |
| 4,522,162 | A | | 6/1985 | Nikolich | |
| 4,665,868 | A | * | 5/1987 | Adams | 123/46 SC |
| 4,712,379 | A | | 12/1987 | Adams et al. | |
| 5,181,495 | A | | 1/1993 | Gschwend et al. | |

(Continued)

FOREIGN PATENT DOCUMENTS

| | | |
|---|---|---|
| JP | 63-174883 | 7/1988 |

(Continued)

OTHER PUBLICATIONS

Japanese Office Action for Application No. 2003-377872, dated Feb. 14, 2008.

(Continued)

*Primary Examiner*—Louis K. Huynh
*Assistant Examiner*—Nathaniel Chukwurah
(74) *Attorney, Agent, or Firm*—Lahive & Cockfield, LLP; Anthony A. Laurentano, Esq.

(57) ABSTRACT

It is an object of the present invention to provide a combustion power tool having a rational construction. A representative combustion power tool according to the invention may include a combustion chamber, a fuel supplier to supply fuel into the combustion chamber, an igniter disposed in the combustion chamber, a driving mechanism actuated to perform a predetermined operation by utilizing a combustion pressure generated when the fuel is burned in the combustion chamber and an actuator that operates the fuel supplier and the igniter in one operation. Based on the operation of the actuator, fuel is supplied into the combustion chamber via the fuel supplier and the igniter performs ignition in relation to the pressure of the fuel supplied into the combustion chamber changes. According to the invention, because the fuel supplying and ignition can be done by the actuator in one operation, ignition can be performed in constant timing after fuel is supplied via the fuel supplying means. As a result, the operability can be improved and stable combustion can be always achieved.

12 Claims, 15 Drawing Sheets

U.S. PATENT DOCUMENTS

| | | | | |
|---|---|---|---|---|
| 5,191,861 | A * | 3/1993 | Kellerman et al. | 123/46 SC |
| 5,680,980 | A * | 10/1997 | Robinson | 227/10 |
| 6,318,615 | B1 * | 11/2001 | Walter | 227/10 |
| 6,425,354 | B1 * | 7/2002 | Buchel et al. | 123/46 R |
| 6,634,325 | B1 | 10/2003 | Adams | |
| 6,779,493 | B2 * | 8/2004 | Doherty et al. | 123/24 A |
| 2002/0134069 | A1 | 9/2002 | Adams | |
| 2002/0144498 | A1 | 10/2002 | Adams | |

FOREIGN PATENT DOCUMENTS

| | | |
|---|---|---|
| JP | 1-188284 | 7/1989 |
| JP | 5-44501 | 2/1991 |
| JP | 3-281921 | 12/1991 |
| JP | 2002-155843 | 5/2002 |
| JP | 2002-321167 | 11/2002 |
| JP | 2002-332888 | 11/2002 |
| JP | 2003-157951 | 5/2003 |

OTHER PUBLICATIONS

Japanese Office Action for Application No. 2003-386436, dated Mar. 19, 2008.

* cited by examiner

COMBUSTION POWER TOOL

BACKGROUND OF THE INVENTION

1. Field of the Invention

The present invention relates to a power tool that performs a predetermined operation by utilizing a high pressure generated upon combustion of flammable gas.

2. Description of the Related Art

Japanese non-examined laid-open Patent Publication No. 1-34753 (D1) discloses an example of a combustion power tool, such as a nailing machine and a tacker. In D1, fuel is supplied into a combustion chamber via a fuel injector and ignited to burn. The burned gas is exhausted to the outside to complete the nailing operation.

Beside the disclosure of D1, it is further desired to provide a combustion power tool in which the timing of the ignition and exhaustion of the burned gas can be optimized.

SUMMARY OF THE INVENTION

Accordingly, it is an object of the invention to provide a combustion power tool having a rational construction.

A representative combustion power tool according to the invention may include a combustion chamber, a fuel supplier to supply fuel into the combustion chamber, an igniter disposed in the combustion chamber, a driving mechanism actuated to perform a predetermined operation by utilizing a combustion pressure generated when the fuel is burned in the combustion chamber and an actuator that operates the fuel supplier and the igniter in one operation. Based on the operation of the actuator, fuel is supplied into the combustion chamber via the fuel supplier and the igniter performs ignition in relation to the pressure of the fuel supplied into the combustion chamber changes.

According to the invention, because the fuel supplying and ignition can be done by the actuator in one operation, ignition can be performed in constant timing after fuel is supplied via the fuel supplying means. As a result, the operability can be improved and stable combustion can be always achieved. Other objects, features and advantages of the present invention will be readily understood after reading the following detailed description together with the accompanying drawings and the claims.

DETAILED DESCRIPTION OF THE INVENTION

Figure 1:
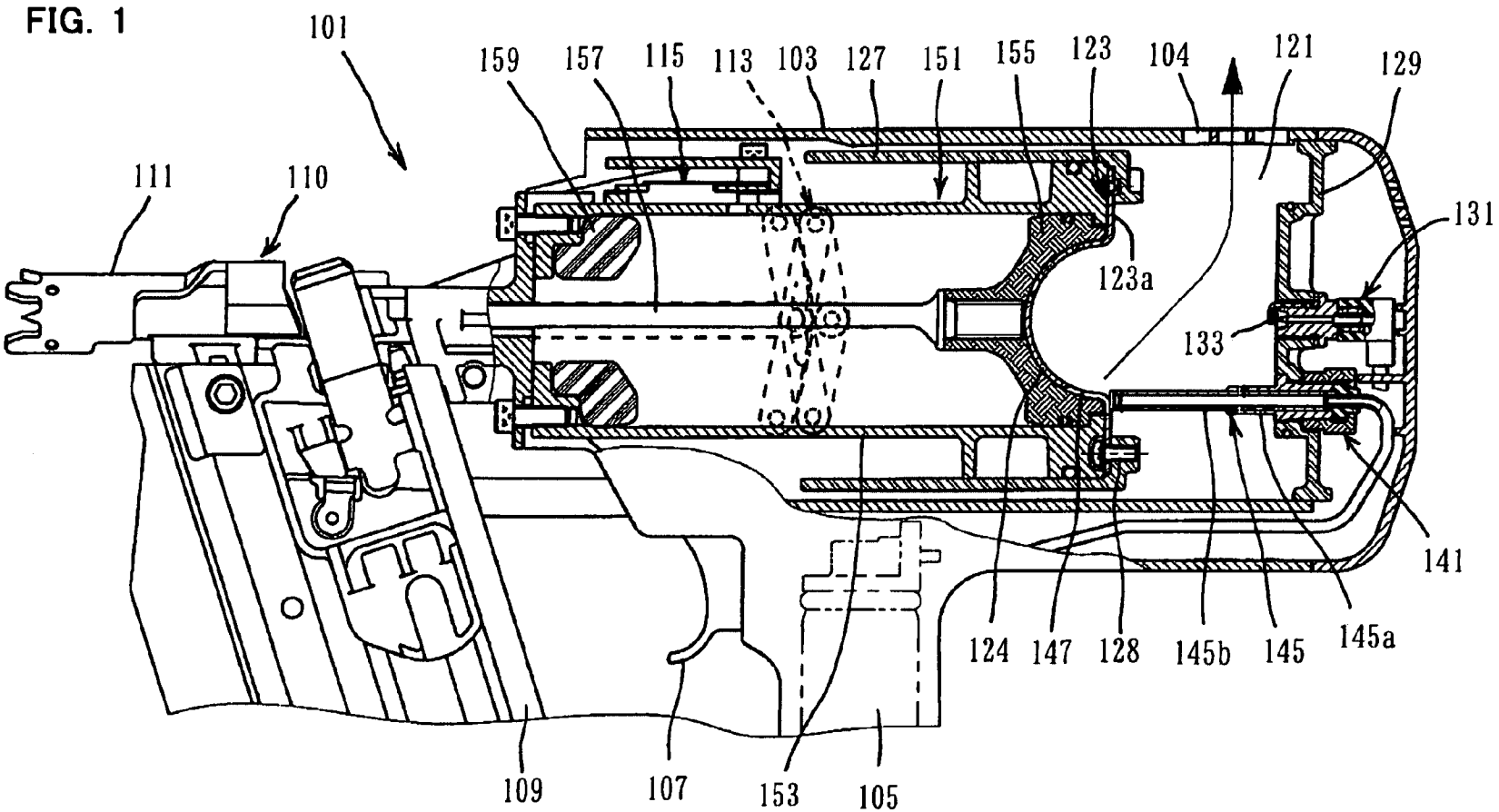
FIG. 1 is a front view, partly in section, showing an entire nailing machine according to an embodiment of the invention, its initial state.

The representative combustion power tool may include a combustion chamber, a fuel supplier, an igniter, a driving mechanism and an actuator. The flammable gas may include a mixture of air and fuel which are appropriately mixed and atomized. Fuel is supplied into the combustion chamber via the fuel supplier and mixed with air in the combustion chamber to form the flammable gas. The igniter ignites flammable gas to burn within the combustion chamber. The driving mechanism performs a predetermined operation by utilizing a combustion pressure generated by such igniting and burning action. The "predetermined operation" is typically defined by an operation for driving nails, staples and so on.

The actuator operates the fuel supplier and the igniter in one operation. Upon the operation of the actuator, fuel is supplied into the combustion chamber via the fuel supplier, while the igniter performs ignition in relation to the pressure change of the fuel supplied into the combustion chamber. The feature of "one operation" may typically mean the manner that when the actuator is once operated to perform fuel supplying, the igniter can be operated without any further operation of the actuator. For example, when the actuator is defined by a trigger, "one operation" in the invention typically means the manner of actuating the fuel supplier and the igniter in single depressing operation of the trigger. Otherwise, when the actuator is defined by a push button, "one operation" may mean the manner of actuating the fuel supplier and the igniter in single pushing operation of the button. The feature of "fuel supplied into the combustion chamber" means not only the fuel which is flowing from the fuel storage to the combustion chamber through the flow passage, but the fuel which has been supplied into the combustion chamber. Further, feature of "pressure change of the fuel" typically means the pressure change caused during the period from the start to the end of the fuel supply, and suitably includes both the manner in which the pressure is lower and the manner in which the pressure is higher at the end than at the start. According to the invention, when the user operates the actuator, regardless of the operating speed, ignition can be performed in constant timing after fuel is supplied via the fuel supplier. Thus, the operability can be improved and stable combustion can be always achieved.

As another aspect of the invention, the representative combustion power tool may include first and second combustion chambers, an igniter, a partition, a plurality of communication holes, a guide cylinder, a piston, an inlet. Flammable gas is charged into the first and second combustion chambers. The igniter is disposed in the first combustion chamber. The partition separates the first combustion chamber from the second combustion chamber. Each communication hole is formed in the partition to communicate the first combustion chamber with the second combustion chamber. The guide cylinder is connected to the second combustion chamber. The piston is sidably disposed within the guide cylinder. The piston performs a predetermined operation by utilizing a combustion pressure. The combustion pressure is generated when flammable gas in the first combustion chamber is burned by the igniter and when the burning front of the flammable gas in the first combustion chamber propagates to the second combustion chamber through the communication holes of the partition and burns flammable gas in the second combustion chamber. The piston is retracted by utilizing a negative pressure caused by cooling and contracting action when the combustion gas within the first and the second combustion chambers is discharged to the outside. The outside air is taken into the first combustion chamber via the inlet by utilizing the negative pressure caused within the first and the second combustion chambers. The air that has been taken into the first combustion chamber flows into the second combustion chamber via the communication holes of the partition together with the combustion gas remaining in the first combustion chamber. Thus, the combustion gas remaining in the first combustion chamber can be efficiently discharged into the second combustion chamber. Further, the air that has flown into the second combustion chamber helps discharging the combustion gas remaining in the second combustion chamber to the outside when the second combustion chamber is allowed to communicate with the outside.

Each of the additional features and method steps disclosed above and below may be utilized separately or in conjunction with other features and method steps to provide and manufacture improved combustion power tools and method for using such combustion power tools and devices utilized therein. Representative examples of the present invention, which examples utilized many of these additional features and method steps in conjunction, will now be described in detail with reference to the drawings. This detailed description is merely intended to teach a person skilled in the art further details for practicing preferred aspects of the present teachings and is not intended to limit the scope of the invention. Only the claims define the scope of the claimed invention. Therefore, combinations of features and steps disclosed within the following detailed description may not be necessary to practice the invention in the broadest sense, and are instead taught merely to particularly describe some representative examples of the invention, which detailed description will now be given with reference to the accompanying drawings.

First Representative Embodiment

Figure 2:
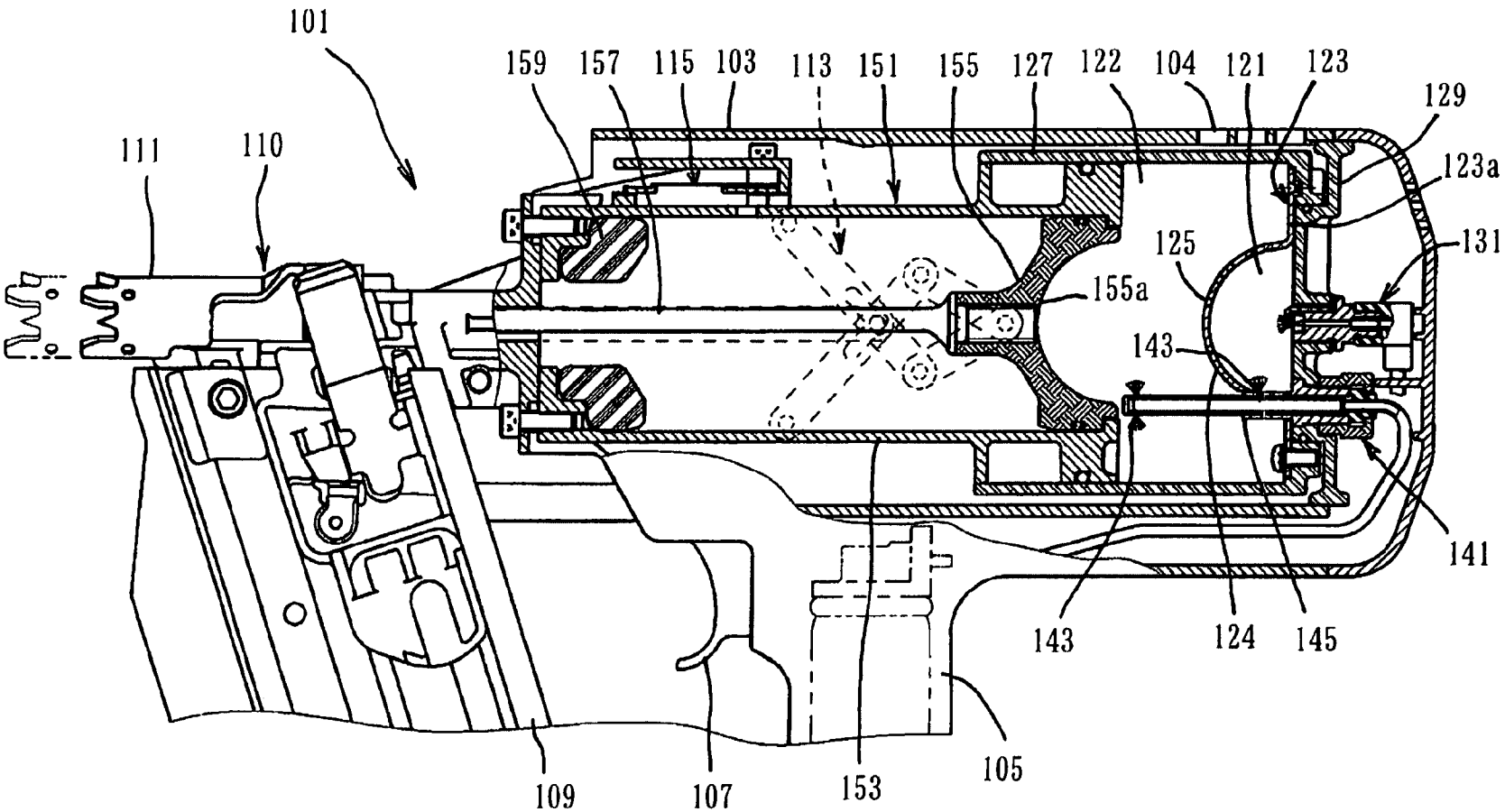
FIG. 2 is also a front view, partly in section, showing the entire nailing machine in the state in which ignition is performed.
Figure 3:
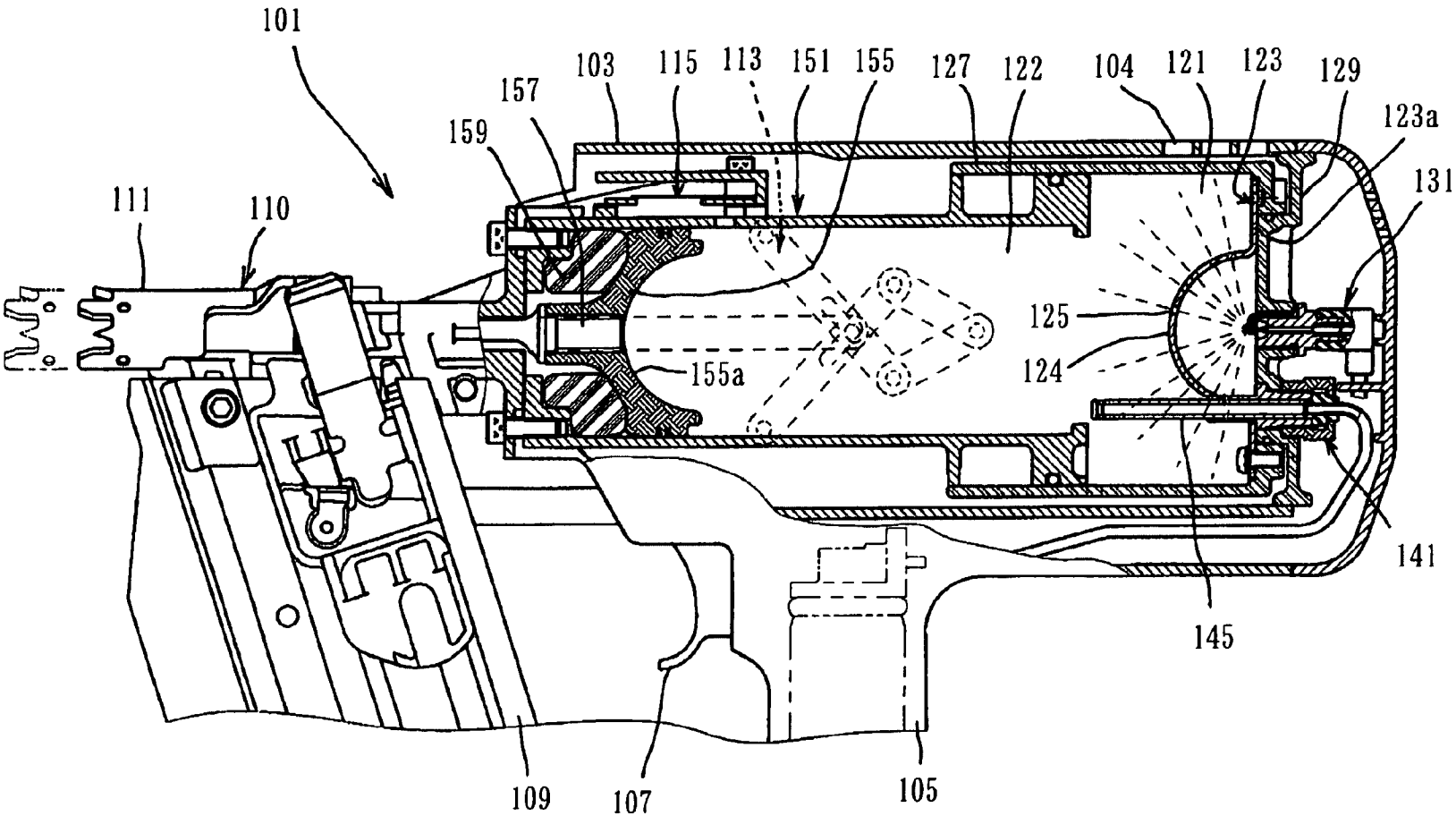
FIG. 3 is also a front view, partly in section, showing the entire nailing machine in the state in which explosion is caused.

First representative embodiment of the invention will now be described with reference to the drawings. As shown in FIGS. 1 to 3, a nailing machine 101 as a representative embodiment of the combustion power tool according to the invention includes a main housing 103, a nail ejection part 110, a handgrip 105 and a magazine 109. The main housing 103 houses a first combustion chamber 121, a second combustion chamber 122, an igniter 131, a fuel injector 141 and a driving mechanism 151. Bleed holes 104 are formed in the main housing 103 near the first combustion chamber 121 in the main housing 103. The first combustion chamber 121 can communicate with the outside through the bleed holes 104. The first and the second combustion chambers 121, 122 and the fuel injector 141 are features that correspond to the "combustion chamber" and the "fuel supplier" of the invention, respectively. A trigger 107 is provided on the handgrip 105. When the user depresses the trigger 107, fuel is supplied into the combustion chambers 121, 122 and ignited. The trigger 107 is a feature that corresponds to the "actuator" of the invention.

As shown in FIG. 2, the first combustion chamber 121 is defined by a partition 123 and a housing cap 129 having substantially flat end wall surface. The partition 123 separates the first combustion chamber 121 from the second combustion chamber 122 and the housing cap 129 is located on the opposite side of the second combustion chamber 122. The partition 123 has a flat portion 123*a* on its periphery and a spherical portion 124 on its central portion. The spherical portion 124 bulges to the side of the second combustion chamber 122. When the flat portion 123*a* is in contact with the end wall surface of the housing cap 129, the spherical portion 124 and the housing cap end wall surface define the first combustion chamber 121. The spherical portion 124 has a hemispherical shape with its center on an ignition part 133 of the igniter 131. In this embodiment, the first combustion chamber 121 is used as an area for igniting a mixture, while the second combustion chamber 122 is used as an area for generating high combustion energy required for a nailing operation.

Numerous communication holes 125 are formed through the spherical portion 124 of the partition 123. The first combustion chamber 121 communicates with the second combustion chamber 122 via the communication holes 125. The partition 123 is fixedly connected to the end portion of the slide sleeve 127 on the side of the first combustion chamber 121 by screws 128. The partition 123 can move together with the slide sleeve 127 in the longitudinal direction of the nailing machine 101.

The second combustion chamber 122 is defined by the piston 155 that forms the driving mechanism, the slide sleeve 127 and the partition 123 that faces the piston 155. The top surface (the surface facing the partition 123) of the piston 155 includes a spherical recess 155*a* that is complementary to the spherical portion 124 of the partition 123. The slide sleeve 127 is connected to a contact arm 111 via a pantograph link mechanism 113 which is shown by broken lines in the drawings. Although not particularly shown, the contact arm 111 is normally biased to the forward end side (leftward as viewed in FIGS. 1 to 3) by a biasing means such as a spring. Thus, the slide sleeve 127 moves to the forward end side together with the partition 123 and normally holds the first combustion chamber 121 in an opened state, thereby allowing the combustion chamber 121 to communicate with the outside via the bleed holes 104. At this time, generally the entire surface of the partition 123 is in surface contact with the end surface of the cylinder 153 and the top surface of the piston 155. Thus, the capacity of the second combustion chamber 122 is reduced to zero or nearly to zero. This state is an initial state of the nailing machine 101, which is shown in FIG. 1.

When the nailing machine 101 is moved toward the workpiece (not shown) and the contact arm 111 is pressed upon the workpiece, the contact arm 111 is pushed back by the workpiece and moves against the biasing force of the biasing means in the opposite direction. The retracting movement of the contact arm 111 is transmitted to the slide sleeve 127 via the pantograph link mechanism 113. The pantograph link mechanism 113 has such a link ratio that it can transmit the travel of the contact arm 111 as increased by several times, to the slide sleeve 127. Thus, the slide sleeve 127 and the partition 123 move toward the housing cap 129 and the circumferential edge portion of the partition 123 contacts the end wall surface of the housing cap 129 as shown in FIG. 2. At this time, the first combustion chamber 121 is closed and prevented from communicating with the outside through the bleed holes 104. Specifically, the slide sleeve 127 serves as an element that forms a side wall surface of the second combustion chamber 122 and also as a means for controlling the opening and closing of the combustion chamber such that communication of the first combustion chamber 121 with the outside is allowed and prevented by the axial sliding movement of the nailing machine 101.

The igniter 131 includes a spark plug 133 and a piezoelectric element 134 (see FIGS. 4 to 6) that generates high voltage current. An ignition part 133*a* of the spark plug 133 is disposed generally in the center of the housing cap 129 that includes the end wall surface of the first combustion chamber 121. The ignition part 133*a* is substantially flush with the end wall surface.

The fuel injector 141 includes a pipe-like member 145 that extends from the first combustion chamber 121 into the second combustion chamber 122 through the partition 123. Fuel injection holes 143 are formed in the fuel injector 141 at appropriate points facing the combustion chambers 121, 122. The pipe-like member 145 that forms the fuel injector 141 is fixedly connected to the housing cap 129 at one end and extends to the side of the first and second combustion chambers 121, 122. A through hole 147 is formed in the lower edge portion of the spherical portion 124 of the partition 123, and the pipe-like member 145 is allowed to extend into the second combustion chamber 122 via the through hole 147. The pipe-like member 145 is a stepped pipe having a large-diameter portion 145*a* on its proximal side (fixed end side) and a small-diameter portion 145*b* on the distal end side. When the flat surface 123*a* of the partition 123 contacts the end wall surface of the housing cap 129, the large-diameter portion 145*a* is located (fitted) within the through hole 147 and closes the through hole 147. When the partition 123 moves toward the piston 155, the small-diameter portion 145*b* is located within the through hole 147 or slipped out of the through hole 147, so that the through hole 147 is opened. The through hole 147 includes an exhaust hole through which gas that has been burned (which will be hereinafter referred to as combustion gas) within the second combustion chamber 122 is led into the first combustion chamber 121.

Figure 4:
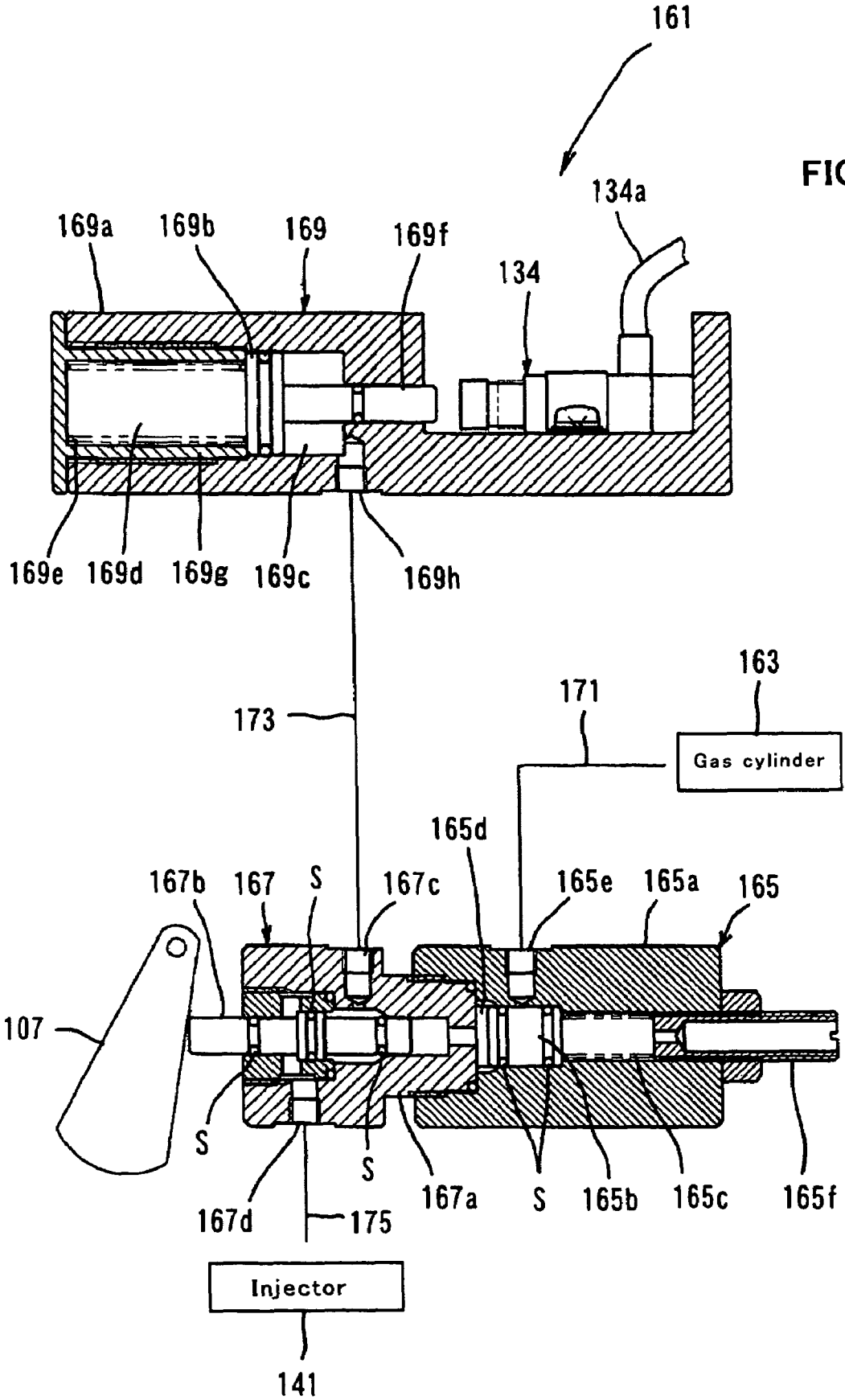
FIG. 4 is a sectional view showing a fuel supplying circuit in its initial state.
Figure 5:
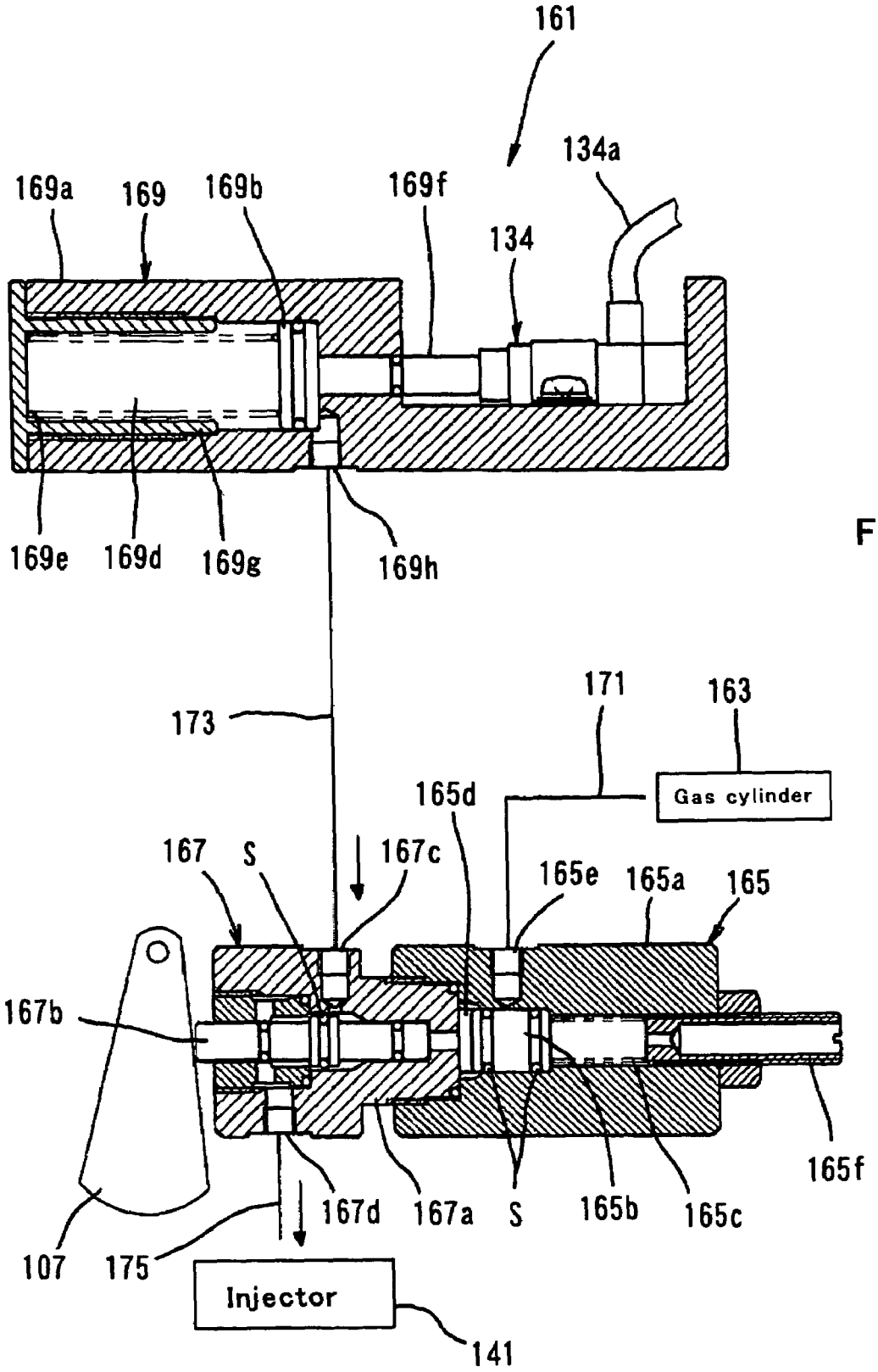
FIG. 5 is a sectional view showing the fuel supplying circuit in the state in which a trigger is depressed.
Figure 6:
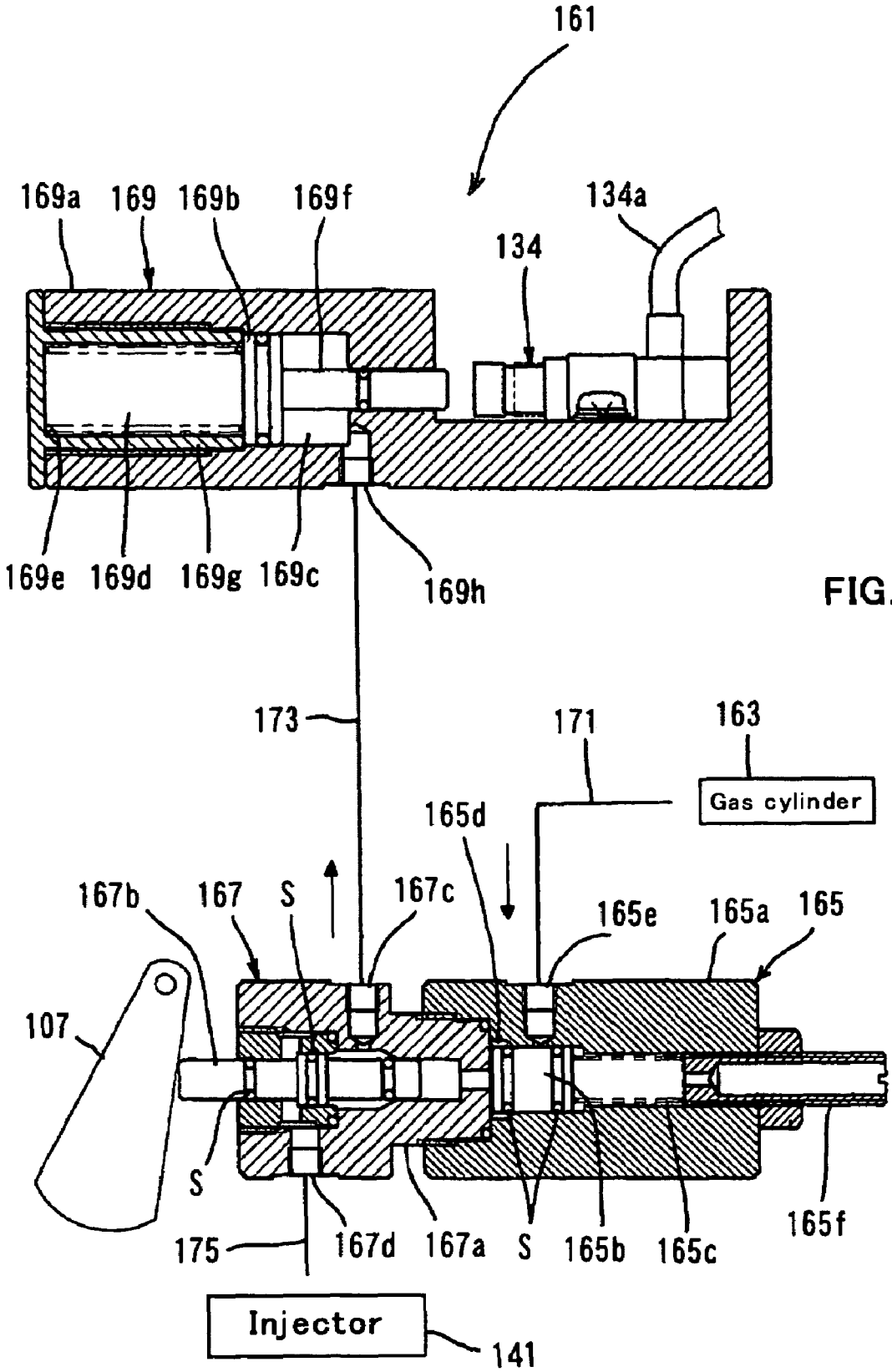
FIG. 6 is a sectional view showing the fuel supplying circuit in the state in which the trigger is returned.
Figure 7:
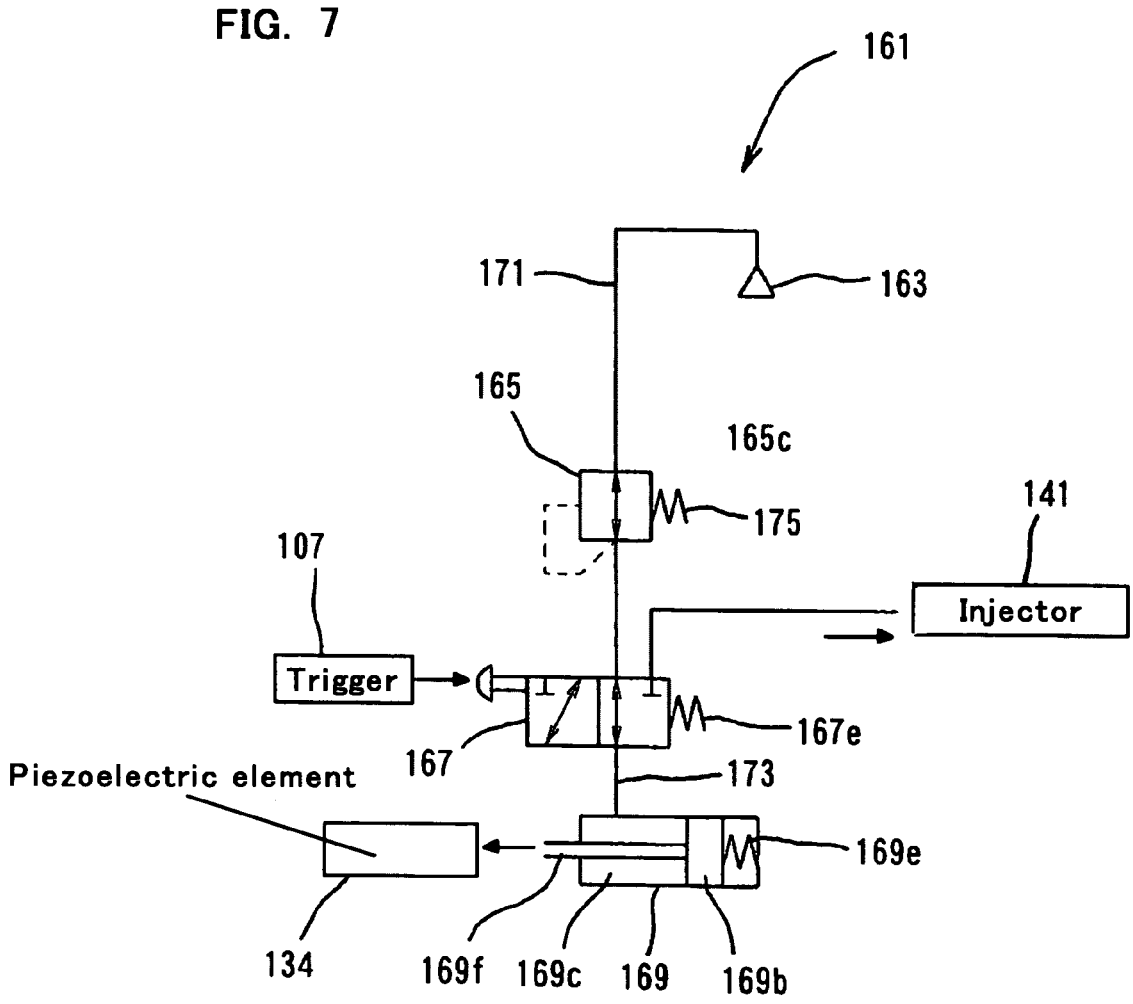
FIG. 7 is a circuit diagram of the fuel supplying circuit

FIGS. 4 to 6 and 7 show a sectional view and a circuit diagram of a fuel supplying circuit 161 for supplying fuel into the combustion chambers. FIG. 4 shows an initial state of the fuel supplying circuit 161, FIG. 5 shows the state when the trigger 107 is depressed, and FIG. 6 shows the state when the trigger 107 is returned. The fuel supplying circuit 161 includes a gas cylinder 163 (shown by phantom line in FIGS. 1 to 3), a diverter valve 167, a fuel meter 169 and a pressure regulator 165. The gas cylinder 163 is disposed as a fuel storage within the handgrip 105 and can be replaced. The diverter valve 167 is actuated by depressing the trigger 107. The fuel meter 169 measures and stores fuel to be supplied into the first and the second combustion chambers 121, 122 in advance. The pressure regulator 165 keeps constant the pressure of the fuel that is stored in the fuel meter 169. The diverter valve 167, the fuel meter 169 and the pressure regulator 165 are disposed within space having appropriate dimensions in the handgrip 105 or the main housing 103.

Fuel is stored in the liquefied state within the gas cylinder 163. The liquefied fuel is vaporized when it flows out of the gas cylinder 163. Then, the fuel is led to the diverter valve 167 via the pressure regulator 165 and then to the fuel meter 169. The fuel which has been led to the fuel meter 169, in the amount required for one combustion, is stored within a measuring chamber 169*c* of the fuel meter 169 and held to a higher pressure than the atmospheric pressure. When the trigger 107 is depressed and the diverter valve 167 is actuated, the fuel is supplied to the above-mentioned fuel injector 141 via the diverter valve 167. The measuring chamber 169*c* is a feature that corresponds to the "auxiliary chamber" of the present invention.

Next, each of the functional parts that form the fuel supplying circuit 161 will now be explained. The pressure regulator 165 includes a spool 165*b* disposed within a valve body 165*a* and can slide. When the spool 165*b* moves in its longitudinal direction, it opens and closes a valve port 165*e* that is connected to the gas cylinder 163 via a piping 171 such as a hose. The spool 165*b* is biased in a direction of opening the valve port 165*e* (leftward as viewed in FIG. 4) by a spring 165*c* applying the spring force to one axial end of the spool 165*b*. When fuel is stored in the measuring chamber 169*c* of the fuel meter 169, the spool 165*b* is held in a position of closing the valve port 165*e* by the pressure within a pressure regulating chamber 165*d* which acts upon the other axial end of the spool 165*b*. This state is shown in FIG. 4. The diverter valve 167 allows and prevents communication of the pressure regulating chamber 165*d* with the measuring chamber 169*c* of the fuel meter 169. The spring force of the spring 165*c* can be appropriately adjusted by turning an adjusting bolt 165*f*.

The fuel meter 169 includes a cylindrical meter body 169*a* and a piston-like member 169*b*. The piston-like member 169*b* is disposed within the meter body 169*a* and can slide. The piston-like member 169*b* partitions the space within the meter body 169*a* into the measuring chamber 169*c* and an atmospheric pressure chamber 169*d*. A port 169*h* of the measuring chamber 169*c* is connected to a first valve port 167*c* of the diverter valve 167 via the piping 173 such as a hose. An accumulator spring 169*e* for pressurizing fuel within the measuring chamber 169*c* is disposed within the atmospheric pressure chamber 169*d*. When the measuring chamber 169*c* communicates with the pressure regulating chamber 165*d* of the pressure regulator 165 via the diverter valve 167, fuel is supplied from the gas cylinder 153 into the measuring chamber 169*c* and applies pressure to the piston-like member 169*b*. Thus, the piston-like member 169*b* moves to the side of the atmospheric pressure chamber 169*d*, while compressing the spring 169*e*. Then, the piston-like member 169*b* abuts against a stopper 169*g* within the atmospheric pressure chamber 169*d*, so that the piston-like member 169*b* is prevented from further movement. At this time, fuel, in a predetermined amount or in the amount required for one combustion, is measured and stored within the measuring chamber 169*c*. This state is shown in FIG. 4.

The piston-like member 169*b* of the fuel meter 169 includes a rod-like member 169*f* that serves as an actuating member for actuating the piezoelectric element 134 of the igniter 131. The rod-like member 169*f* protrudes to the outside through the meter body 169*a*. When fuel within the measuring chamber 169*c* is supplied to the fuel injector 141 via the diverter valve 167 and the fuel supply is completed, the protruded end of the rod-like member 169*f* impulsively strikes the piezoelectric element 134. As a result, the piezoelectric element 134 is caused to generate high voltage current. This state is shown in FIG. 5. The piezoelectric element 134 is disposed near the fuel meter 169 and connected to the ignition part 133*a* of the spark plug 133 via an electrical wiring 134*a*.

The diverter valve 167 is a spool valve having a spool 167*b*. The spool 167*b* is disposed within a valve body 167*a* and can slide in the longitudinal direction of the spool 167*b*. The valve body 167*a* has a first valve port 167*c* and a second valve port 167*d*. The first valve port 167*c* is connected to the port 169*h* of the measuring chamber 169*c*, and the second valve port 167*d* is connected to the fuel injector 141 via the piping 175 such as a hose. In the initial state in which the trigger is not depressed yet, the spool 167*b* is moved to a fuel supply stop position (shown in FIG. 4) by the pressure of the fuel within the pressure regulating chamber 165*d*, which pressure acts upon one axial end (the right end as viewed in FIGS. 4 to 6) of the spool 167*b*. In this position, the spool 167*b* allows the pressure regulating chamber 165*d* to communicate with the first valve port 167*c* (and thus with the measuring chamber 169*c*), while preventing communication between the first valve port 167*c* and the second valve port 167*d*. In the initial state of the diverter valve 167, the spool 167*b* is moved to the fuel supply stop position. This state is shown in FIG. 4. The other axial end of the spool 167*b* contacts the trigger 107 which is located, for example, in its initial position (return position), so that the movement of the spool 167*b* to the fuel supply stop position is controlled.

When the trigger 107 is depressed, the trigger 107 pushes the other axial end (the left end as viewed in FIGS. 4 to 6) of the spool 167*b*, so that the spool 167*b* moves to a fuel supply position (shown in FIG. 5). This state is shown in FIG. 5. When the spool 167*b* moves to the fuel supply position, the first valve port 167*c* is prevented from communication with the pressure regulating chamber 165*d* (and thus with the measuring chamber 169*c*), while being allowed to communicate with the second valve port 167*d*. Specifically, the measuring chamber 169*c* is caused to communicate with the fuel injector 141 by depressing the trigger 107. When the spool 167*b* moves to the fuel supply position, fuel is filled in the pressurized state within the pressure regulating chamber 165*d*. The filled-in gaseous fuel forms a so-called gas spring. The gas spring is designated by 167*e* in the circuit diagram of FIG. 7.

Sealing members (O-rings) are mounted around the spool 165*b* of the pressure regulator 165 and the spool 167*b* of the diverter valve 167. The sealing members are designated by S in FIGS. 4 to 6. The spools 165*b*, 167*b* slide along the sliding surface of the valve bodies 165*a*, 167*a*. As shown in FIGS. 8 to 11, a clearance between the sliding surface and the spools is sealed in the area where the sealing members S are in contact with the sliding surface. On the other hand, a clearance is provided between the sliding surface and the spools in the area where the sealing members S are not in contact with the sliding surface, so that gas is allowed to flow through the clearance.

Figure 8:
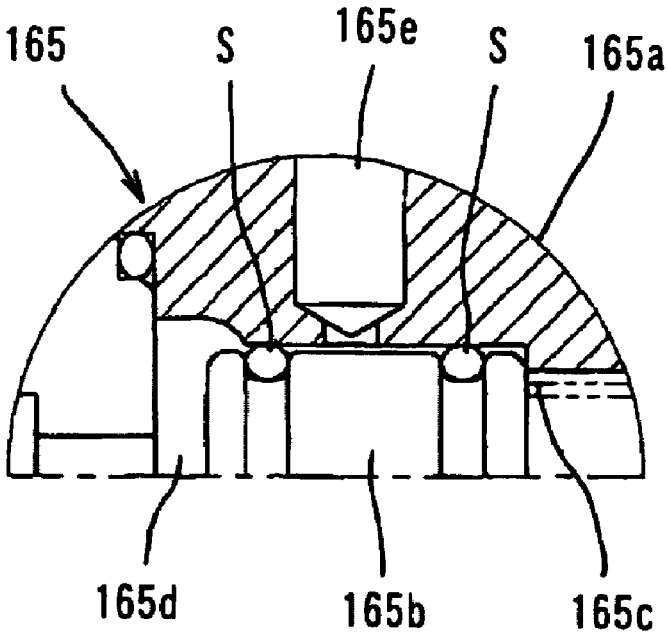
FIG. 8 is an enlarged view showing part of a pressure regulator in the initial state.
Figure 9:
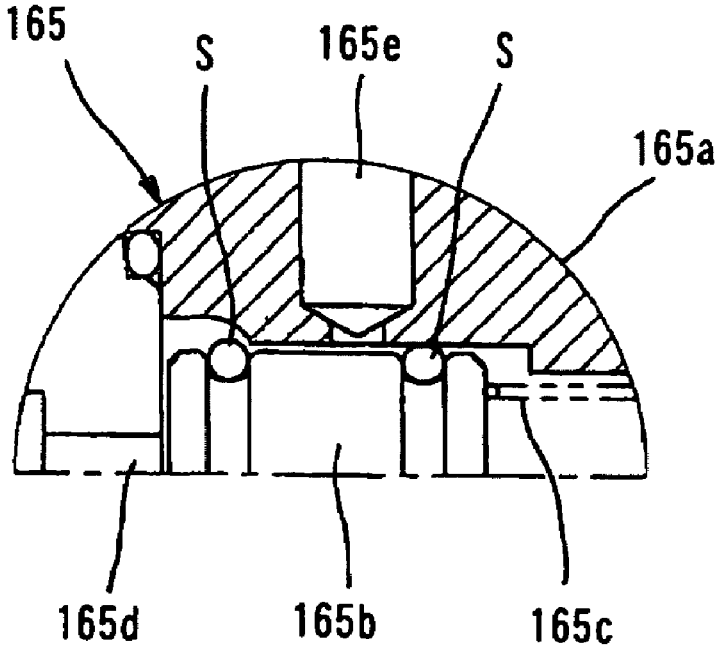
FIG. 9 is an enlarged view showing part of the pressure regulator in the state in which the trigger is returned.
Figure 10:
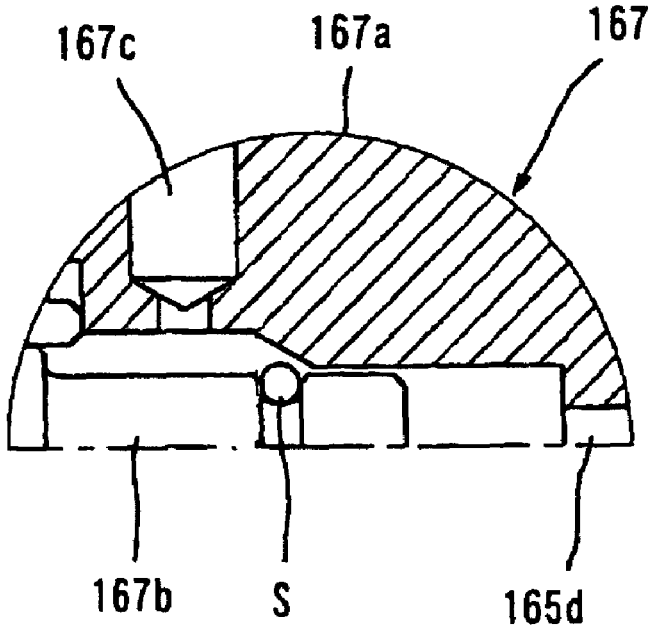
FIG. 10 is an enlarged view showing part of a diverter valve in the state in which a trigger is depressed.
Figure 11:
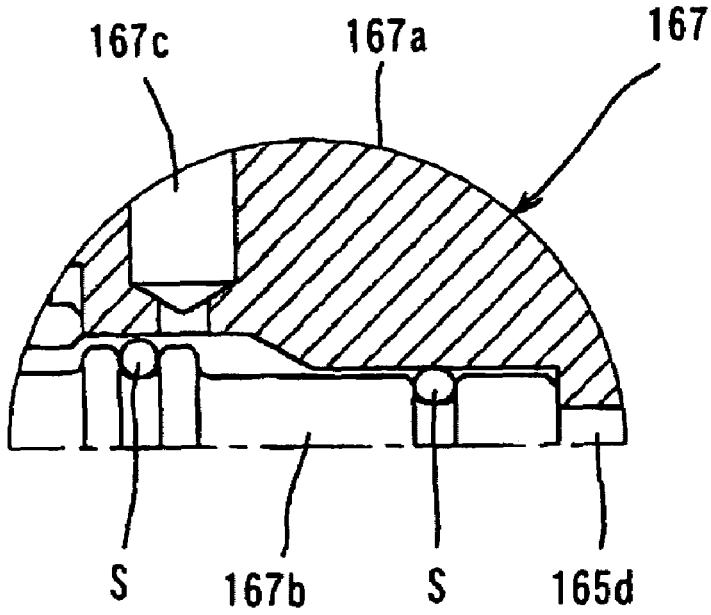
FIG. 11 is an enlarged view showing part of the diverter valve in the initial state.

FIG. 8 shows part of the pressure regulator 165 in the initial state. In this state, two sealing members S contact the inner surface of the valve body 165*a* on the opposite sides of the valve port 165*e* and close the valve port 165*e*. FIG. 9 shows part of the pressure regulator 165 in the state in which the trigger is returned. In this state, the sealing member S on the side of the pressure regulating chamber 165*d* is disengaged from the inner surface of the valve body 165*a* by the movement of the spool 165*b*, which allows communication between the valve port 165*e* and the pressure regulating chamber 165*d*. FIG. 10 shows part of the diverter valve 167 in the initial state. In this state, one sealing member S is disengaged from the inner surface of the valve body 167*a*, which allows communication between the pressure regulating chamber 165*d* of the pressure regulator 165 and the first valve port 167*c*. FIG. 11 shows part of the diverter valve 167 in the state in which the trigger is depressed. In this state, the other sealing member S is disengaged from the inner surface of the valve body 167*a*, which allows communication between the first valve port 167*c* and the second valve port 167*d*.

As shown in FIGS. 1 to 3, the driving mechanism 151 mainly includes a cylinder 153 disposed within the main housing 103, the piston 155 that is slidably disposed within the cylinder 153, and the piston rod 157 that is integrally connected with the piston 155. Although it is not particularly shown, the end of the piston rod 157 is connected to a nail ejecting device that is disposed within a nail ejection part 110 and serves to eject nails N forward. A cushion rubber 159 is disposed in the forward end within the cylinder 153 and serves to absorb and alleviate the impact of the piston 155 which is driven at high speed. A non-return valve 161 is provided on the cylinder 153 and serves to communicate the bore of the cylinder 153 with the outside of the nailing machine 101. The non-return valve 115 is a one-way valve which allows fluid to flow out of the inside of the bore of the cylinder 153, but prevents fluid from flowing from the outside into the bore of the cylinder 153.

Magazine 109 is mounted to the nail ejection part 110 on the forward end of the main housing 103. The magazine 109 contains numerous nails N connected with each other and places a nail N, into the ejection part 110, to be driven next. The construction of the magazine 109 itself is well-known and thus will not be explained in further detail.

Contact arm 111 is mounted on the front end of the ejection part 110. The contact arm 111 can slide with respect to the ejection part 110 in the longitudinal direction of the ejection part 110 (the longitudinal direction of the nailing machine 101) and is normally biased to the forward end side (leftward as viewed in FIG. 1) by a biasing means. This biasing means also serves as a biasing means for the slide sleeve 127.

Operation of the nailing machine 101 constructed as described above will now be explained. The initial state of the nailing machine 101 is shown in FIG. 1 In this state, the slide sleeve 127 is moved to the forward end side by the biasing force of the biasing means, thereby allowing the first combustion chamber 121 to communicate with the outside. Further, the partition 123 is in contact with the cylinder 153 and the piston 155, so that the capacity of the second combustion chamber 122 is reduced substantially to zero. At this time, the pipe-like member 145 is slipped out of the through hole 147 of the partition 123, so that the through hole 147 is opened. Further, at this time, the fuel supplying circuit 161 is in the initial state shown in FIG. 4. In this state, the first valve port 167*c* of the diverter valve 167 communicate with the pressure regulating chamber 165*d* of the pressure regulator 165 (see FIG. 10). Fuel to be supplied to the first and the second combustion chambers 121, 122 is measured in advance and stored in the measuring chamber 169*c*.

In this state, in order to perform a nailing operation, the user of the nailing machine 101 applies a pressing force toward the workpiece W upon the nailing machine 101 with the contact arm 111 being held in contact with the workpiece W. Then, the contact arm 111 retracts in the direction away from the workpiece W against the biasing force of the biasing means. When the contact arm 111 retracts, the slide sleeve 127 connected to the contact arm 111 via the pantograph link mechanism 113 retracts by the stroke several times longer than that of the contact arm 111. By this retracting movement, the partition 123 moves toward the housing cap 129 and the flat surface 123*a* contacts the end wall surface of the housing cap 129, so that the first combustion chamber 121 is cut off from communication with the outside. As a result, as shown in FIG. 2, the ratio of the capacity of the first combustion chamber 121 to that of the second combustion chamber 122 stands at a predetermined ratio. At this time, the large-diameter portion 145*a* of the pipe-like member 145 is fitted into the through hole 147 and closes the through hole 147.

When the user depresses the trigger 107 on the handgrip 105, as shown in FIG. 5, the spool 167*b* of the diverter valve 167 is pushed by the trigger 107 and moved to the fuel supply position. This movement of the spool 167*b* prevents the first valve port 167*c* connected to the measuring chamber 169*c* of the fuel meter 169 from communicating with the pressure regulating chamber 165*d* of the pressure regulator 165, while allowing it to communicate with the second valve port 167*d* connected to the fuel injector 141 (see FIG. 11). As a result, fuel within the measuring chamber 169*c* is supplied to the fuel injector 141. The fuel is supplied (injected) into the combustion chambers 121, 122 through the fuel injection holes 143*a*, 143*b* (see FIG. 2) of the fuel injector 141. The amount of fuel supply into the first and the second combustion chambers 121, 122 is set individually according to the capacity of the associated combustion chambers 121, 122. The injected fuel is mixed with air within the combustion chambers 121, 122. Thus, the first and the second combustion chambers 121, 122 are fully filled with the mixture. The mixture is a feature that corresponds to the "flammable gas" in the invention.

Pressure within the measuring chamber 169*c* is gradually reduced as fuel is supplied into the first and the second combustion chambers 121, 122. At this time, the piston-like member 169*b* to which the spring 169*e* has been applying pressure is moved in a direction of reducing the capacity of the measuring chamber 169*c*. When the fuel supply from the measuring chamber 169*c* to the fuel injector 141 or into the first and the second combustion chambers 121, 122 via the fuel injector 141 has been completed, as shown in FIG. 5, the rod-like member 169*f* impulsively strikes the piezoelectric element 134 of the igniter 131. As a result, high voltage current is generated and causes electric discharge between the electrodes that form the ignition part 133*a* of the spark plug 133. Thus, the mixture is ignited.

Specifically in the nailing machine 101, when the trigger 107 is depressed, a fixed amount of fuel measured and stored within the measuring chamber 169*c* in advance is supplied into the first and the second combustion chambers 121, 122 via the fuel injector 141. The pressure within the measuring chamber 169*c* changes as the fuel is supplied. At this time, ignition by the igniter 131 is performed. Therefore, regardless of the speed with which the user depresses the trigger 107, the relation between the timing of supplying fuel into the first and the second combustion chambers 121, 122 and the timing of ignition can be maintained constant. When the fuel within the measuring chamber 169*c* is supplied into the first and the second combustion chambers 121, 122, the pressure within the measuring chamber 169*c* is reduced to the pressure within the first and the second combustion chambers 121, 122. The pressure within the first and the second combustion chambers 121, 122 is almost equal to the atmospheric pressure when the combustion chambers 121, 122 are cut off from communication with the outside in order to receive the fuel supply. Thus, the pressure within the measuring chamber 169*c* is reduced substantially to the atmospheric pressure when the fuel supply has been completed. Therefore, ignition by the igniter 131 is performed when the fuel pressure within the measuring chamber 169*c* reaches to about the same pressure as the atmospheric pressure.

Upon the ignition operation by the igniter 131, the mixture filled in the first combustion chamber 121 is ignited starting from the region in the vicinity of the ignition part 133 and thus starts burning. The burning action of the mixture is explosive and thus, the burning front (flame front) of the mixture reaches the partition 123 in an extremely short time. The partition 123 includes the spherical portion 124 having its center on the ignition part 133. Thus, the burning front of the mixture originating from the ignition part 133 reaches the entire spherical portion 124 substantially at the same time. Therefore, ignition in the second combustion chamber 122 can be started simultaneously over the interface of the partition 123 through the communication holes 125. Thus, the timing of starting combustion in the second combustion chamber 122 can be effectively controlled.

The mixture filled in the second combustion chamber 122 is ignited simultaneously over the entire surface region of the partition 123 and thus, combustion of the mixture starts within the second combustion chamber 122. The second combustion chamber 122 has a larger capacity than the first combustion, and a greater combustion pressure is generated by combustion of the mixture within the second combustion chamber 122. As a result, as shown in FIG. 3, the piston 155 slides (advances) toward the workpiece W within the cylinder 153.

When the piston 155 slides within the cylinder 153, the space within the cylinder 153 on the side of the piston rod 157 is reduced. However, such space reduction does not prevent the sliding movement of the piston 155, because air within the reduced space is allowed to escape to the outside via the non-return valve 115 as shown in FIG. 3.

When the piston 155 slides within the cylinder 153, the piston rod 157 moves linearly toward the workpiece. As a result, a nail placed in the ejection part 110 is ejected at a high speed toward the workpiece and driven into the workpiece. At this time, the piston 155 that has moved at high speed toward the workpiece within the cylinder 153 abuts against the cushion rubber 159. The cushion rubber 159 absorbs and alleviates the kinetic energy of the piston 155 so that the piston 155 stops.

In the stage of completing the operation of driving nails, the inside of the first and the second combustion chambers 121, 122 which have expanded due to the sliding movement of the cylinder 155 is cooled. As a result, the piston 155 automatically starts retracting in the direction away from the workpiece. Further, when the user stops applying the pressing force on the nailing machine in the direction toward the workpiece, the contact arm 111 which has retracted relatively toward the main housing 103 moves forward (toward the workpiece) by the biasing force of the biasing means. Upon such movement of the contact arm 111, the slide sleeve 127 and the partition 123 move forward (toward the piston 155). As a result, the first combustion chamber 121 is opened. Thus, the first combustion chamber 121 communicates with the outside of the nailing machine 101 via the bleed holes 104 of the main housing 103.

The forward movement of the partition 123 is governed by the time when the user stops applying the pressing force on the nailing machine in the direction toward the workpiece. This movement of the partition 123 is performed after the piston 155 has completed its retracting movement. Specifically, the retracting movement of the piston 155 is instantaneously achieved by the suction force which is caused by the cooling action within the first and the second combustion chambers 121, 122. Therefore, as long as the user stops applying the pressing force on the nailing machine in the direction toward the workpiece in a normal manner, the piston 155 completes its retracting movement and is returned to its initial position from which it starts moving forward.

With such retracting movement of the piston 155 and the forward movement of the partition 123 (toward the piston 155), the capacity of the second combustion chamber 122 starts decreasing. By the forward movement of the partition 123, the bleed holes 104 are opened and the first combustion chamber 121 communicates with the outside. Further, the through hole 147 slips away from the large-diameter portion 145*a* and receives the small-diameter portion 145*b*, so that the through hole 147 is opened. As a result, a gas flow from the through hole 147 to the bleed holes 104 is formed within the first combustion chamber 121. Thus, the combustion gas remaining within the second combustion chamber 122 is introduced into the first combustion chamber 121 through the through hole 147 and then discharged to the outside through the bleed holes 104 together with the combustion gas within the first combustion chamber 121. The partition 123 moves into contact with the piston 155. As a result, the capacity of the second combustion chamber 122 is reduced to zero or nearly to zero. At this time, the small-diameter portion 145*b* of the pipe-like member 145 completely slips out of the through hole 147 and the through hole 147 is fully opened. Thus, the nailing machine 101 is returned to its initial position shown in FIG. 1.

When the user releases the trigger 107 (generally before stopping applying a pressing force toward the workpiece upon the nailing machine), as shown in FIG. 6, the spool 167*b* of the diverter valve 167 is released from pressure applied by the trigger 107. Thus, the spool 167*b* is returned to the fuel supply stop position by the action of the so-called gas spring 167*e* (see FIG. 7) which is formed by the pressure of fuel filled in the pressure regulating chamber 165*d*. As a result, the first valve port 167*c* of the diverter valve 167 is prevented from communication with the second valve port 167*d* and allowed to communicate with the pressure regulating chamber 165*d* (see FIG. 1). The pressure regulating chamber 165*d* is thus allowed to communicate with the measuring chamber 169*c* of the fuel meter 169 via the first valve port 167*c*, so that the pressure within the pressure regulating chamber 165*d* is reduced. Then, the spool 165*b* of the pressure regulator 165 is moved by the biasing force of the spring 165*c*. As a result, the valve port 165*e* is opened. In other words, the valve port 165*e* communicates with the pressure regulating chamber 165*d* (see FIG. 9). Thus, the gas cylinder 163 communicates with the measuring chamber 169*c*, and the fuel within the gas cylinder 163 is supplied into the measuring chamber 169*c*. Pressure within the measuring chamber 169*c* is gradually raised as the fuel is supplied. Thus, the piston-like member 169*b* moves toward the atmospheric pressure chamber 169*d* while compressing the accumulator spring 169*e*. When the piston-like member 169*b* contacts the stopper 169*g* and is prevented from further movement, or thereafter when the pressure within the pressure regulating chamber 165*d* is raised to a predetermined pressure, the spool 165*b* of the pressure regulator 165 is moved rightward (as viewed in the drawing) against the biasing force of the spring 165*c* and closes the valve port 165*e* (see FIG. 8). Thus, the fuel supply circuit 161 is returned to its initial state shown in FIG. 4.

Thus, when the user depresses the trigger 107, regardless of its speed, ignition is performed in constant timing with respect to fuel supply. Therefore, operability of the trigger can be improved and stable combustion can be achieved. Further, fuel is not uselessly supplied even if the user interrupts the depressing operation of the trigger 107. Further, the operation is simplified compared with the construction, for example, in which fuel is supplied when the contact arm 111 is pressed against the workpiece and retracts while ignition is performed when the trigger 107 is depressed. Moreover, with the construction in which fuel is not supplied only by pressing the contact arm 111 against the workpiece, fuel is not uselessly supplied even if the user presses the contact arm 111 against the workpiece and thereafter releases it.

Particularly, in this embodiment, a fixed amount of fuel is measured and stored within the measuring chamber 169*c* of the fuel meter 169 in advance. The fuel is supplied to the fuel injector 141 via the diverter valve 167 actuated by depressing the trigger 107. Further, the fuel is injected into the first and the second combustion chambers 121, 122 via the fuel injector 141. Pressure within the measuring chamber 169*c* changes as the fuel is supplied into the first and the second combustion chambers 121, 122. At this time, the igniter 131 is actuated via the rod-like member 169*f*, so that ignition is performed. Therefore, the timing of ignition is always maintained constant with respect to the fuel injection into the first and the second combustion chambers 121, 122. As a result, ignition can be performed when the fuel and air within the combustion chambers 121, 122 are brought to a properly mixed state. Thus, stable combustion can be achieved.

In this embodiment, when the fuel pressure within the measuring chamber 169*c* is reduced nearly to the atmospheric pressure, the piezoelectric element 134 of the igniter 131 is actuated via the rod-like member 169*f*. Instead of such construction, it may be constructed such that a signal is detected, for example, as an electric signal, when the fuel pressure within the measuring chamber 169*c* is reduced to below a certain value (set pressure). After a predetermined time period after such detection of the signal, a timer, for example, may be activated and the igniter 131 may be actuated upon time-out, so that ignition is performed. In this case, instead of detecting the change of pressure within the measuring chamber 169*c*, it may be constructed such that the fuel pressure is detected by pilot pressure in the intermediate region between the measuring chamber 169*c* and the first and the second combustion chambers 121, 122, or in the fuel supply passage that connects the measuring chamber 169*c* and the first and the second combustion chambers 121, 122.

Further, in this embodiment, ignition is performed when pressure within the measuring chamber 169*c* changes. However, it may be constructed such that ignition is performed when pressure within the first and the second combustion chambers 121, 122 changes instead of the measuring chamber 169. Fuel supply into the first and the second combustion chambers 121, 122 can be performed in a state in which the combustion chambers are sealed from the outside. Therefore, pressure within the first and the second combustion chambers 121, 122 is raised as fuel is supplied into the sealed combustion chambers 121, 122. Pressure within the combustion chambers 121, 122 is almost equal to the atmospheric pressure before fuel supply. Therefore, it may be constructed such that a signal is detected when the fuel pressure within the combustion chambers 121, 122 exceeds a certain value (set pressure). After a lapse of a predetermined time period after such detection of the signal, a timer, for example, may be activated and the igniter 131 may be actuated upon time-out, so that ignition is performed.

Further, in this embodiment, the nailing machine 101 has been described as a representative example as having the combustion chamber partitioned by the partition 123 into the two combustion chambers 121, 122. This invention can also be applied to a nailing machine having single combustion chamber.

Second Representative Embodiment

Second representative embodiment of the invention will now be described in reference to FIGS. 12 to 18 in detail. In the following description of the second embodiment, detailed explanation will be abbreviated with respect to the same features as described in the first embodiment.

Figure 16:
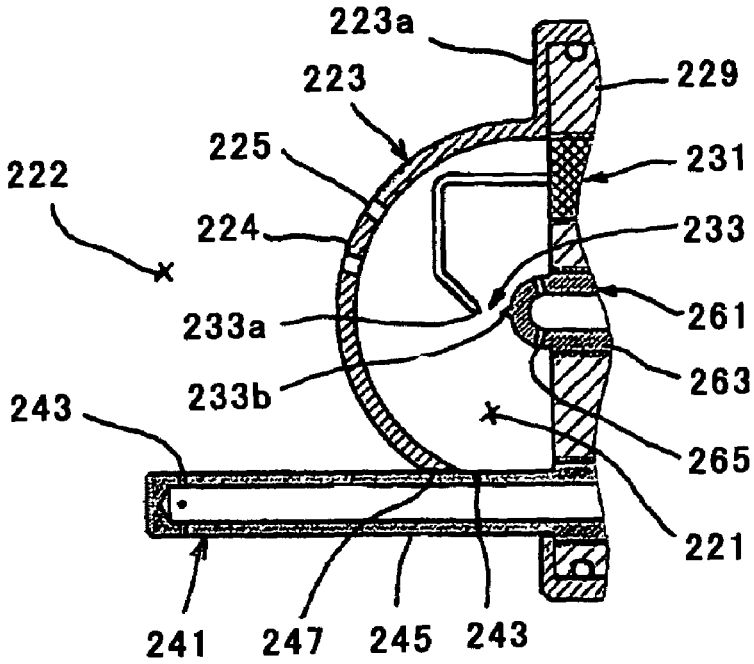
FIG. 16 is an enlarged sectional view showing a first combustion chamber and its surroundings.

In addition to the features as provided in the first embodiment, the nailing machine 201 according to the second embodiment includes a suction device 261. The suction device 261 serves to take fresh air into the first combustion chamber 221 when combustion gas and flammable gas that has been burned, in the first and the second combustion chambers 221, 222 is discharged to the outside. As shown in FIG. 16, the suction device 261 mainly includes a suction nozzle 263 that is fixedly mounted generally in the central portion of the housing cap 229. The suction nozzle 263 includes a plurality of inlets 265. The tip end portion of the suction nozzle 263 has a hemispherical shape which is generally similar in shape to the spherical portion 224 of the partition 223. The inlets 265 are formed at predetermined spacing in the spherical portion of the suction nozzle 263. In this embodiment, the area of the opening of each of the inlets 265 is smaller than the area of an open circle having a diameter of 1 mm. The other electrode 233*b* of the ignition part 233 is provided on the central portion of the end of the suction nozzle 263.

Figure 12:
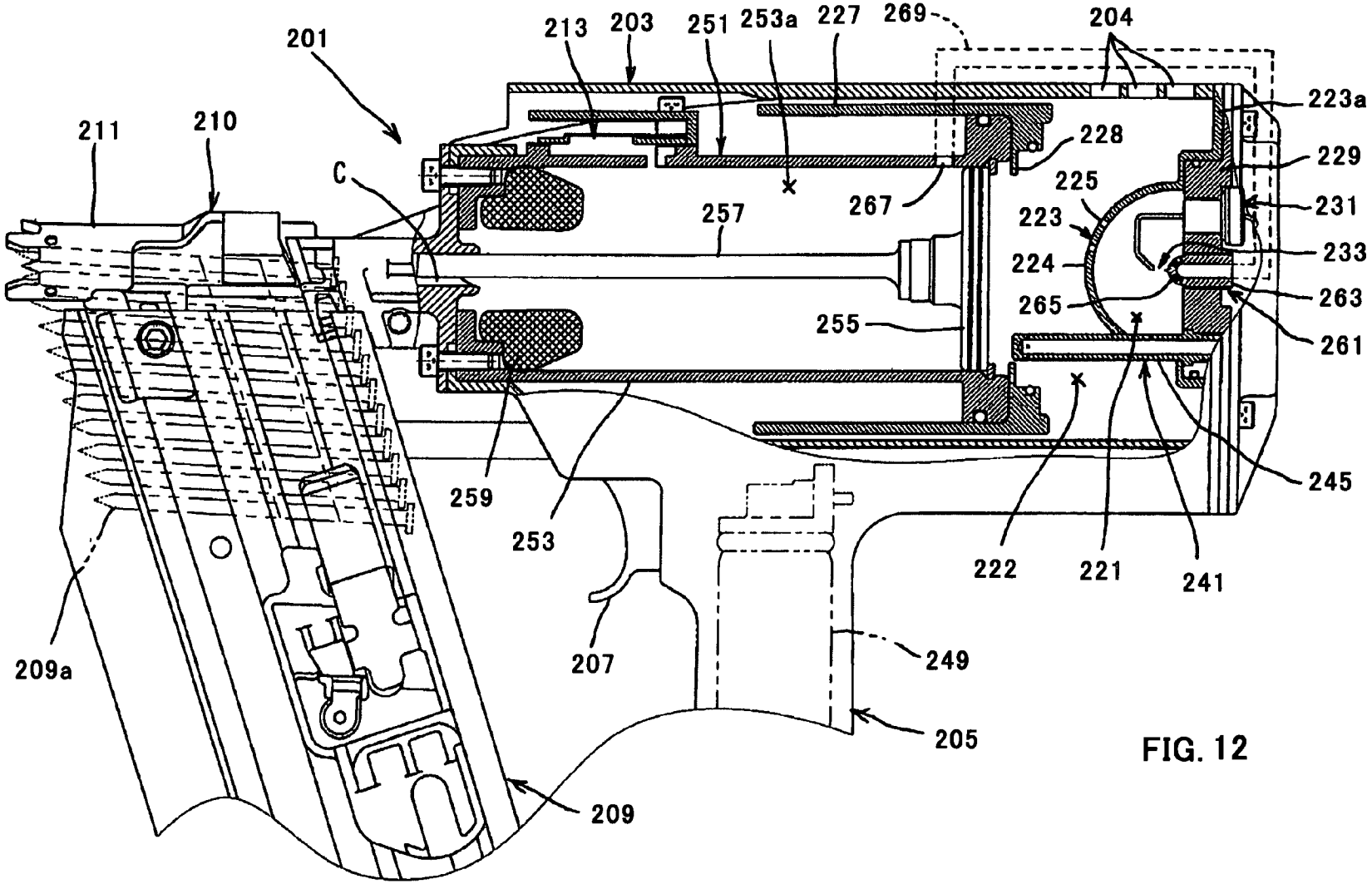
FIG. 12 is a front view, partly in section, showing an entire nailing machine according to the second embodiment of the invention, in its initial state in which a piston is on the upper dead center.
Figure 13:
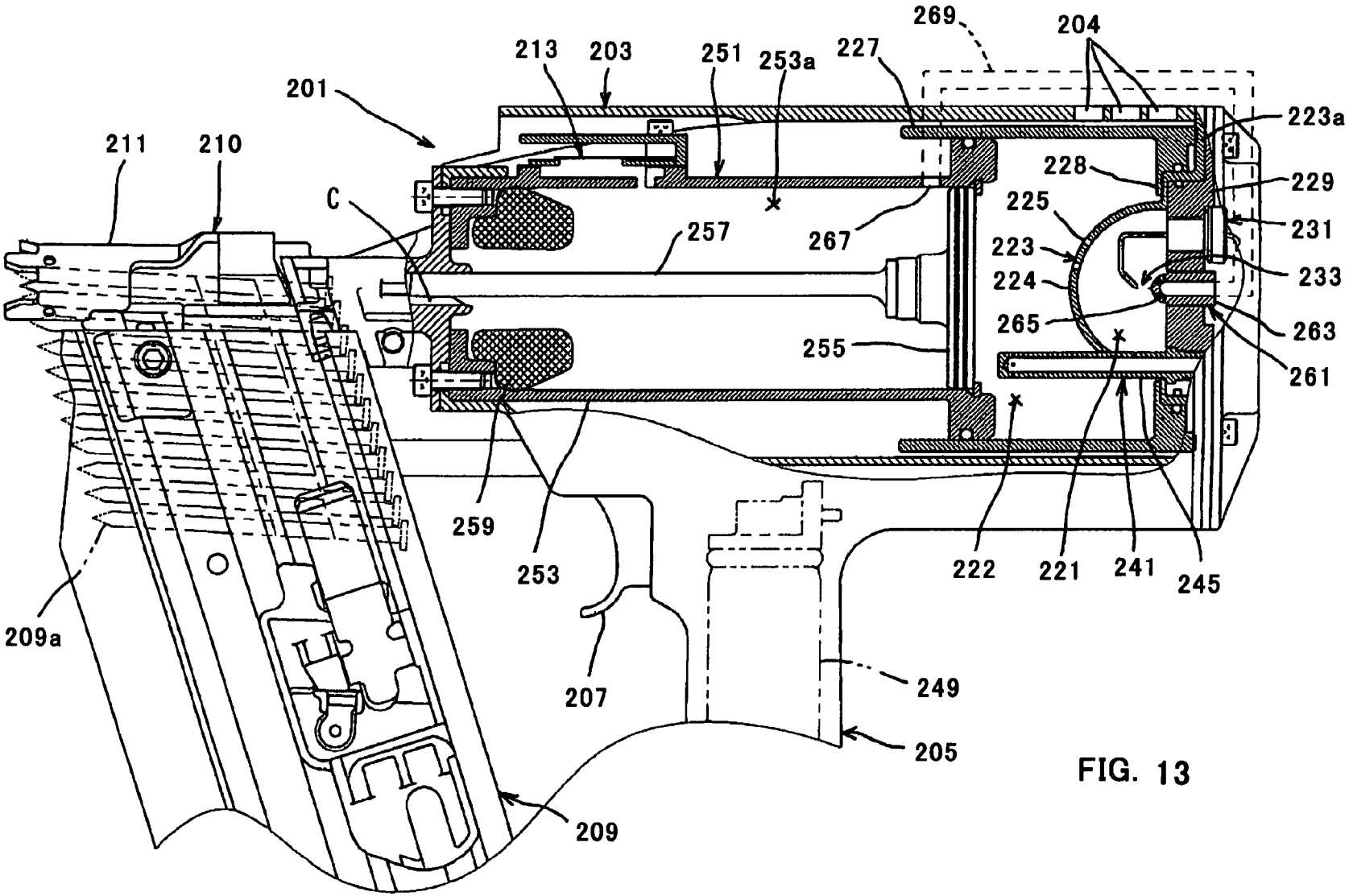
FIG. 13 is also a front view, partly in section, showing the entire nailing machine of the second embodiment in the state in which a slide sleeve is moved toward a partition and closes a second combustion chamber.
Figure 14:
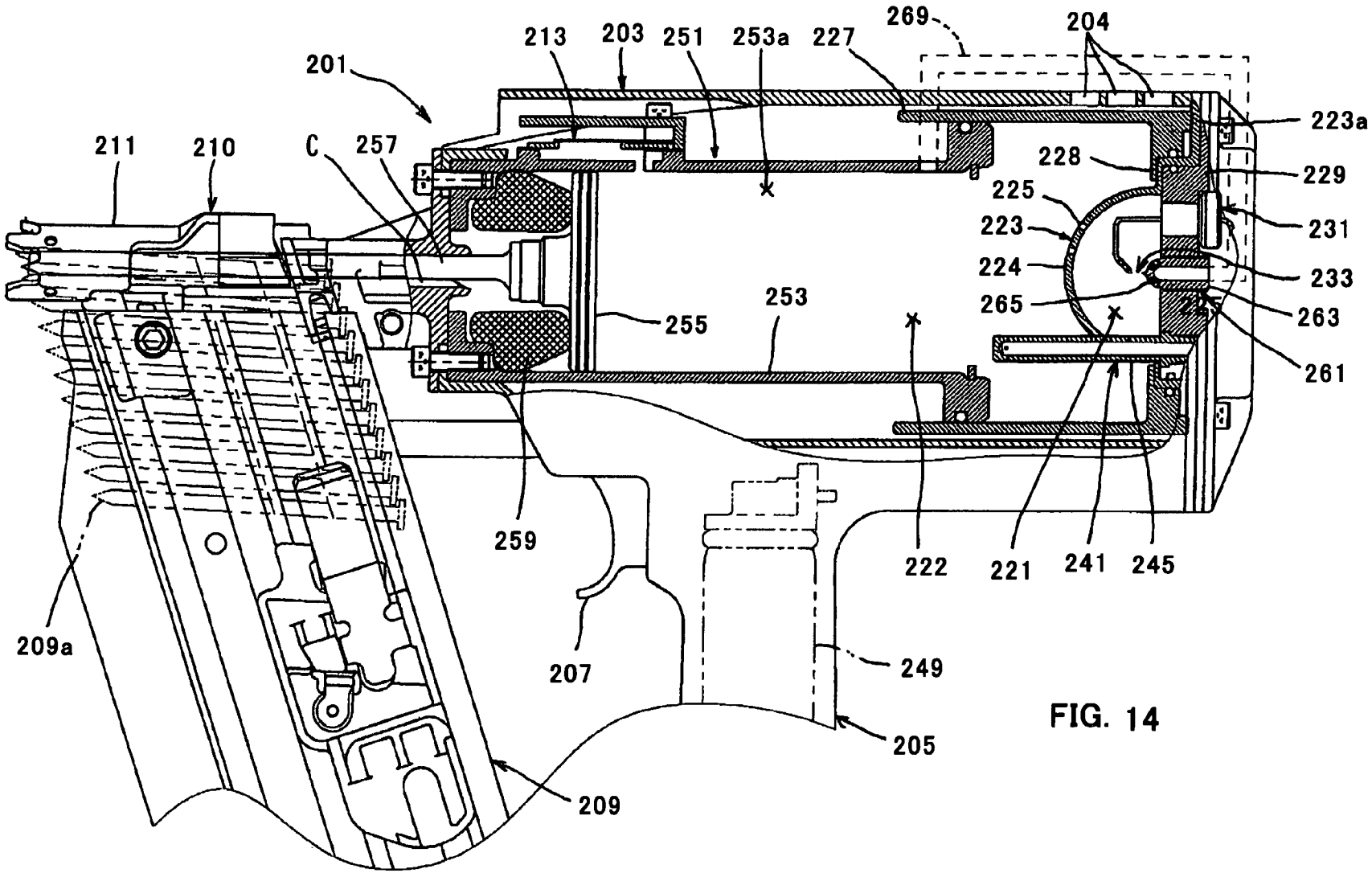
FIG. 14 is also a front view, partly in section, showing the entire nailing machine of the second embodiment in the state in which the piston is moved to the lower dead center and the nailing operation has been completed.

The suction nozzle 263 always communicates with an air intake 267 via a tubular member 269, such as a pipe or hose, which serves as a communication passage. The air intake 267 is formed through the wall of the cylinder 253. The air intake 267 always communicates with the inside (bore 253*a*) of the cylinder 253. As shown in FIG. 12, when the piston 255 is retracted farthest toward the partition 223 to the upper dead center (the initial position or the "retracting end" in this invention), the air intake 267 is situated forward (downward) of the piston 255. On the other hand, when the piston 255 is advanced toward the front end to the lower dead center (the driving completion position or the "advancing end" in this invention), the air intake 267 is situated rearward (upward) of the piston 255. The bore 253*a* of the cylinder 253 communicates with the atmosphere via a clearance C that is formed between the outer circumferential surface of the piston rod 257 and the inner circumferential surface of the bore of the contact arm 211 through which the piston rod 257 extend. Therefore, when the piston 255 is on the upper dead center, the suction nozzle 263 is allowed to communicate with the outside (atmosphere) via the bore 253*a* of the cylinder 253, the air intake 267 and the tubular member 269. On the other hand, when the piston 255 is on the lower dead center, the suction nozzle 263 is allowed to communicate with the second combustion chamber 222 via the bore 253*a* of the cylinder 253 and is cut off from communication with the outside.

Figure 15:
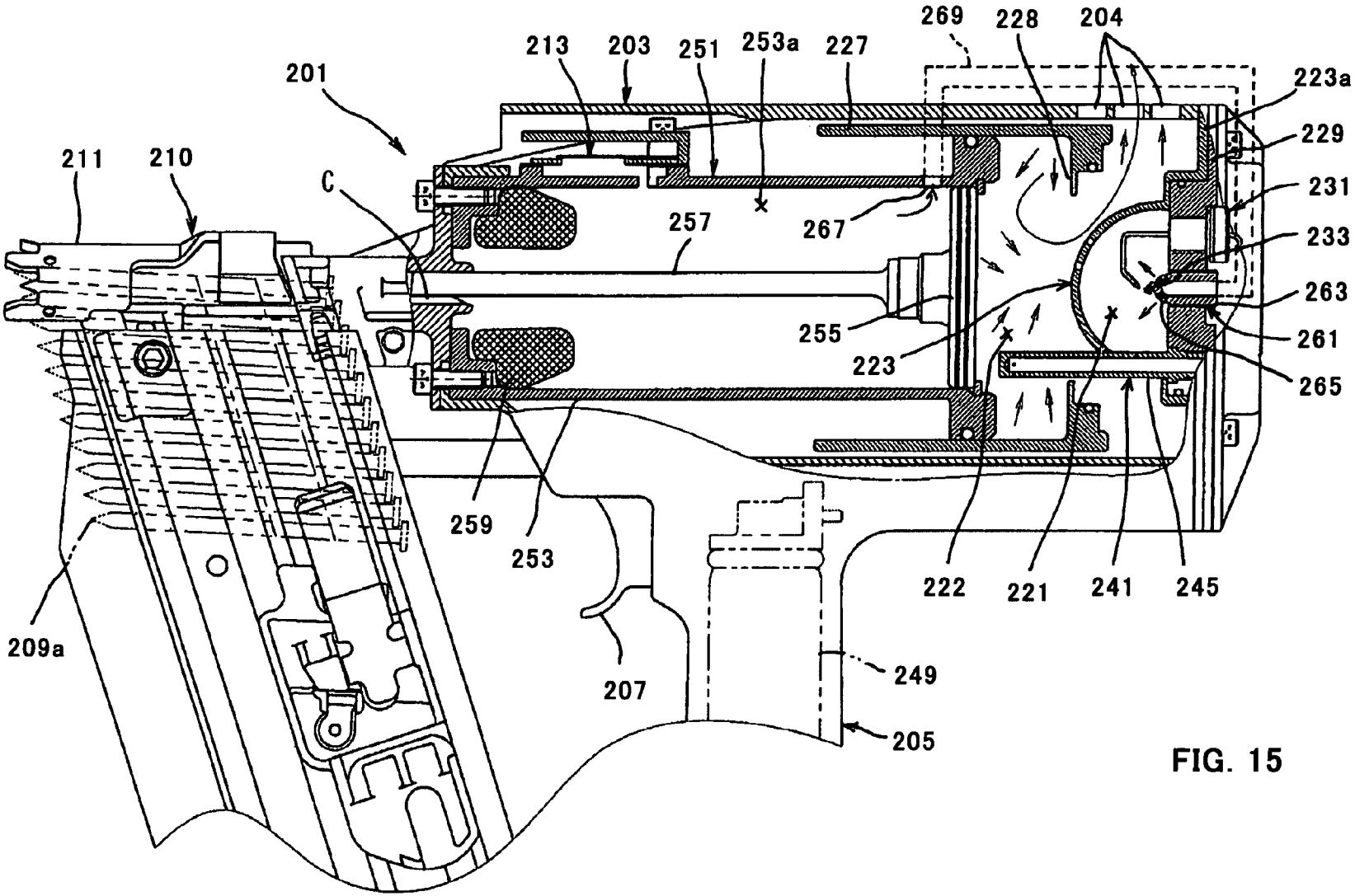
FIG. 15 is also a front view, partly in section, showing the entire nailing machine in the state in which remaining gas is discharged.

Further, as shown in FIG. 15, the slide sleeve 227 forms a side wall surface of the second combustion chamber 222 and includes a wall plate 228. When the slide sleeve 227 is moved away from the partition 223, the second combustion chamber 222 is opened and combustion gas is discharged to the outside. At this time, the wall plate 228 serves to push out the combustion gas in order to facilitate such discharge. The wall plate 228 comprises a circular flange that is formed on one end of the slide sleeve 227 which faces the partition 223. The circular flange extends in a predetermined extent inward in a direction of crossing the moving direction of the slide sleeve 227 and has a continuous configuration in its circumferential direction.

Magazine 209 is mounted to the nail ejection part 210 on the forward end of the main housing 203 of the nailing machine 201. The magazine 209 contains numerous nails 209*a* connected with each other and places a nail 209*a*, into the ejection part 210, to be driven next.

Contact arm 211 is mounted on the front end of the ejection part 210. The contact arm 211 can slide with respect to the ejection part 210 in the longitudinal direction of the ejection part 210 (the longitudinal direction of the nailing machine 201) and is normally biased to the forward end side (leftward as viewed in FIG. 12) by a biasing means. This biasing means also serves as a biasing means for the slide sleeve 227.

Operation of the nailing machine 201 constructed as described above will now be explained. The initial state of the nailing machine 201 is shown in FIG. 12. In this state, the slide sleeve 227 is moved to the forward end side by the biasing force of the biasing means, thereby allowing the second combustion chamber 222 to communicate with the outside via the bleed holes 204. Further, the piston 255 is situated on the upper dead center, so that the air intake 267 of the cylinder 253 is opened forward of the piston 255. Thus, the suction nozzle 263 is allowed to communicate with the outside (atmosphere).

In the stage of completing the operation of driving the nails 109*a*, the inside of the first and the second combustion chambers 221, 222 is contracted and cooled. Thus, a negative pressure is formed within the combustion chambers 221, 222 and causes a sucking action. As a result, the piston 255 automatically starts retracting in the direction away from the workpiece. Further, when the user stops applying the pressing force on the nailing machine 201 in the direction toward the workpiece, the contact arm 211 which has retracted relatively toward the main housing 203 moves forward (toward the workpiece) by the biasing force of the biasing means. When the contact arm 211 moves, the slide sleeve 227 moves forward (toward the piston 255). As a result, as shown in FIG. 15, the slide sleeve 227 moves apart from the partition 223 such that the second combustion chamber 222 is opened. Thus, the second combustion chamber 222 communicates with the outside of the nailing machine 201 via the bleed holes 204 of the main housing 203.

The forward movement of the slide sleeve 227 is governed by the time when the user stops applying the pressing force on the nailing machine 201 in the direction toward the workpiece. This movement of the slide sleeve 227 is performed after the piston 255 has completed its retracting movement. Specifically, the retracting movement of the piston 255 is instantaneously achieved by the suction force which is caused by the cooling action within the first and the second combustion chambers 221, 222. Therefore, as long as the user stops applying the pressing force on the nailing machine 201 in the direction toward the workpiece in a normal manner, the piston 255 completes its retracting movement and is returned to its initial position (shown in FIG. 12) from which it starts moving forward.

When the piston 255 passes the air intake 267 during its retracting movement by the sucking action which is caused by the negative pressure within the combustion chambers 221, 222, as shown in FIG. 15, the air intake 267 communicates with the outside. As a result, air in the atmosphere is led into the tubular member 269 and sucked into the first combustion chamber 221 via the inlets 265 of the suction nozzle 263. In this embodiment, the inlets 265 are arranged in the spherical portion of the suction nozzle 263 which is similar in shape to the spherical portion 224 of the partition 223. Therefore, air is radially sucked into the first combustion chamber 221. In this manner, fresh air can be evenly led into the first combustion chamber 221. The air that has been sucked into the first combustion chamber 221 flows into the second combustion chamber 222 via the communication holes 225 of the partition 223 together with the combustion gas remaining within the first combustion chamber 221. Thus, the combustion gas remaining within the first combustion chamber 221 can be actively and efficiently discharged into the second combustion chamber 222.

Further, by the forward movement of the slide sleeve 227, as shown in FIG. 15, the second combustion chamber 222 is opened and communicates with the outside via the bleed holes 204. Thus, the combustion gas within the second combustion chamber 222 is discharged to the outside via the bleed holes 204. At this time, the wall plate 228 serves to pressurize the combustion gas within the second combustion chamber 222 and push it out toward the center of the combustion chamber 222, so that flow of the combustion gas within the second combustion chamber 222 is facilitated. The wall plate 228 is formed on one end of the slide sleeve 227 which faces the partition 223 (on the rear end of the slide sleeve 227 in its moving direction) and extends in a direction of crossing the moving direction of the slide sleeve 227. Thus, the combustion gas remaining within the second combustion chamber 222 can be actively and efficiently discharged to the outside.

When the slide sleeve 227 moves forward, as mentioned above, air flows from the first combustion chamber 221 into the second combustion chamber 222 via the communication holes 225 of the partition 223. At this time, through the numerous communication holes 225 in the spherical portion 224 of the partition 223, air generally evenly flows into all over the inside of the second combustion chamber 222. Thus, substitution of air for combustion gas (ventilation) is smoothly performed. Particularly in a continuous nailing operation, this is effective in obtaining a proper mixing ratio of the mixture of air and fuel to be injected next into the first and the second combustion chambers 221, 222.

As mentioned above, in this embodiment, after completion of the nailing operation of driving the nails 209*a* by the piston 255, fresh air is taken into the first and the second combustion chambers 221, 222. With this construction, discharge of the combustion gas remaining within the first and the second combustion chambers 221, 222 can be facilitated. Particularly with the construction in which air is taken in by utilizing the negative pressure which is caused by cooling and contracting action within the first and the second combustion chambers 221, 222, the combustion gas can be efficiently discharged with a simple structure. Further, the nailing machine 201 of this embodiment has a construction in which the first combustion chamber 221 has a dome-like shape, or which the first combustion chamber 221 communicates with the second combustion chamber 222 via the communication holes 225 and is sealed from the outside. Generally, in such a construction, combustion gas does not easily discharged from the first combustion chamber 221. Therefore, adoption of the above-mentioned air intake method in such a nailing machine 201 is extremely effective in enhancing the effectiveness of discharging the combustion gas.

Further, in this embodiment, the discharge of the combustion gas is facilitated by the wall plate 228 of the slide sleeve 227 by utilizing the movement of the slide sleeve 227 which causes the second combustion chamber 222 to be opened. Such construction does not need a separate system for the purpose of such discharge of the combustion gas and is suitable for simplifying the structure.

Further, in this embodiment, intake of air into the first combustion chamber 221 by the suction nozzle 263, or communication of the suction nozzle 263 with the outside, is allowed or interrupted depending on the position of the piston 255. Specifically, an existing member or the piston 255 serves as an opening and closing valve for controlling the air intake by the suction nozzle 263. Thus, such construction does not need the opening and closing valve and is effective in simplifying the structure and reducing the costs. Further, the position of the air intake 267 of the cylinder 253 with respect to the piston 255 can be appropriately changed in the moving direction of the piston 255. In this manner, the timing of taking air into the first combustion chamber 221 can be freely determined with respect to the timing of returning the piston 255 to the initial position. In this manner, an influence which may be exerted on the retracting movement of the piston 255, or an influence which may be caused by decrease of the negative pressure within the first and the second combustion chambers 221, 222, when air is taken into the first combustion chamber 221 via the inlets 265, can be avoided. Thus, the piston 255 can be reliably returned to its initial position.

Modification of Second Embodiment

Figure 17:
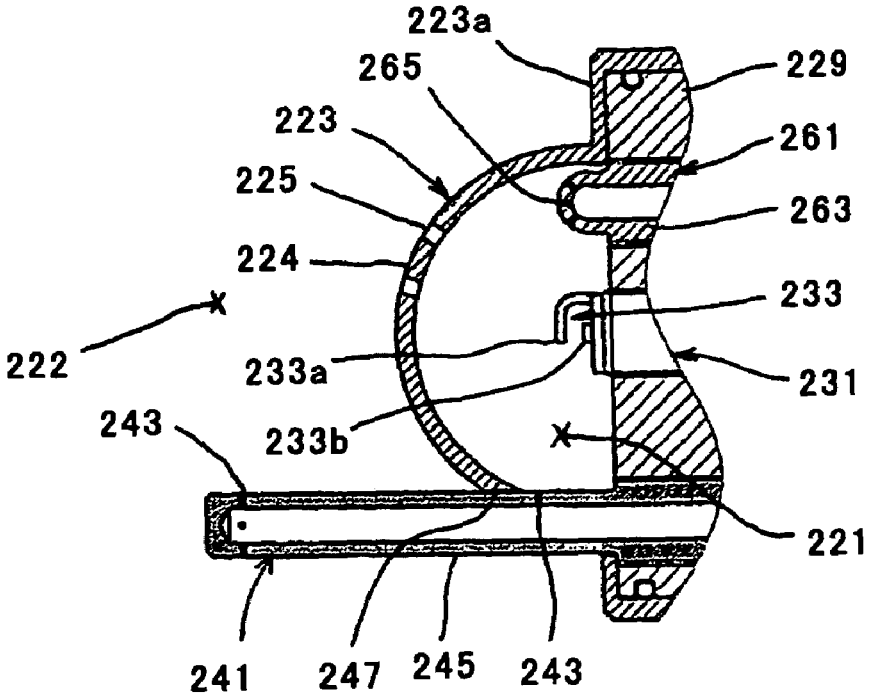
FIG. 17 is a sectional view showing a different embodiment of a suction nozzle of a suction device.
Figure 18:
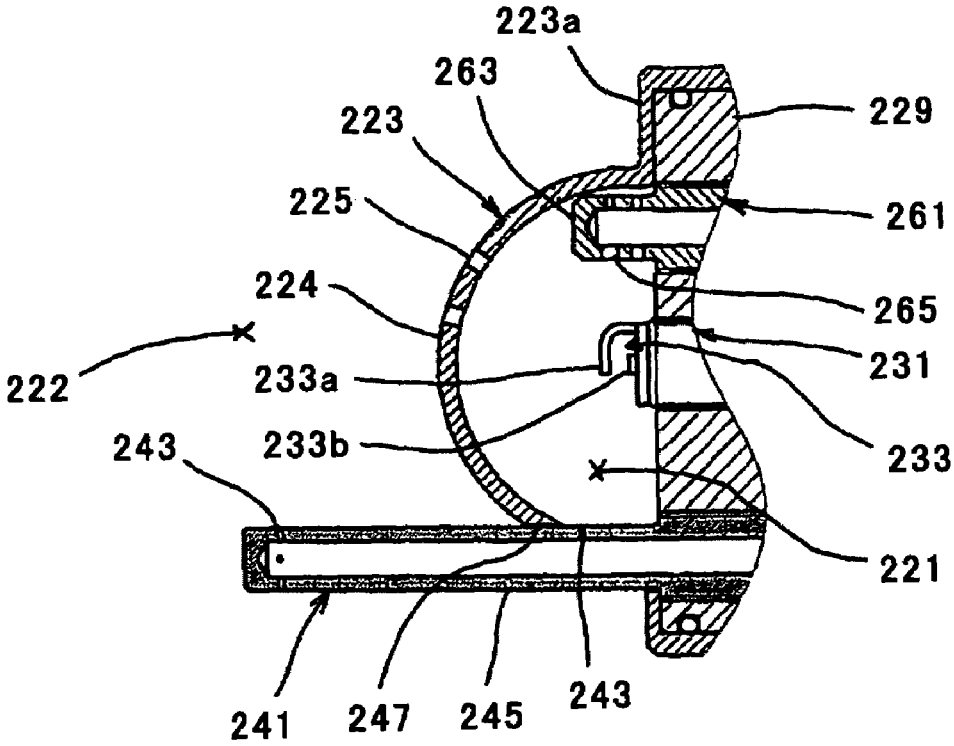
FIG. 18 is a sectional view showing a modification of the suction nozzle of the suction device according to the second embodiment.

FIGS. 17 and 18 show different embodiments of the suction device 261 for taking fresh air into the first combustion chamber 221. In the embodiments shown in FIGS. 17 and 18, the igniter 231 is disposed generally in the center of the housing cap 229 or in the center of the spherical portion 224 of the partition 223 which defines the first combustion chamber 221. In this connection, the suction device 261 is disposed near the edge of the housing cap 229 (on the side opposite to the fuel injector 241 with respect to the igniter 231) such that it is situated near the edge of the spherical portion 224. Further, in the embodiment shown in FIG. 17, the tip end portion of the suction nozzle 263 has a spherical shape, and a plurality of inlets 265 are formed in the spherical portion. In the embodiment shown in FIG. 18, the tip end portion of the suction nozzle 263 protrudes into the first combustion chamber 221 in a predetermined extent, and a plurality of inlets 265 are formed in the circumferential surface of the protruding end portion. According to this modification, the suction device 261 has much the same effect of taking in air as in the second embodiment.

According to the above-explained embodiments, the wall plate 228 is formed on one end of the slide sleeve 227 which faces the partition 223, or on the rear end of the slide sleeve 227 in the direction in which it moves to open the second combustion chamber 222. On the other hand, the wall plate 228 may be provided on the slide sleeve 227 at a halfway point in the moving direction. Further, while the wall plate 228 has a continuous configuration in its circumferential direction, it may have a discontinuous configuration in its circumferential direction.

DESCRIPTION OF NUMERALS

101 nailing machine (combustion power tool)
103 main housing
104 bleed hole
105 handgrip
107 trigger
109 magazine
110 ejection part
111 contact arm
113 pantograph link mechanism
115 non-return valve

121 first combustion chamber
122 second combustion chamber
123 partition
123*a* flat surface
124 spherical portion
125 communication hole
127 slide sleeve
128 screw
129 housing cap
131 igniter
133 spark plug
133*a* ignition part
134 piezoelectric element
134*a* electrical wiring
141 fuel injector (fuel supplier)
143 fuel injection hole
145 pipe-like member
145*a* large-diameter portion
145*b* small-diameter portion
147 through hole
151 driving mechanism
153 cylinder
155 piston
155*a* spherical recess
157 piston rod
159 cushion rubber
161 fuel supplying circuit
163 gas cylinder (fuel storage)
165 pressure regulator
165*a* valve body
165*b* spool
165*c* spring
165*d* pressure regulating chamber
165*e* valve port
165*f* adjusting bolt
167 diverter valve
167*a* valve body
167*b* spool
167*c* first valve port
167*d* second valve port
167*e* gas spring
169 fuel meter
169*a* meter body
169*b* piston-like member
169*c* measuring chamber
169*d* atmospheric pressure chamber
169*e* spring
169*f* rod-like member
169*g* stopper
169*h* port
171 piping
173 piping
175 piping
S sealing member

We claim:

1. A combustion power tool comprising:

a combustion chamber in which a fuel is burned, a fuel supplier that supplies the fuel into the combustion chamber, the fuel supplier comprising a fuel tank, and an auxiliary chamber coupled to the fuel tank, an igniter disposed in the combustion chamber, a driving mechanism actuated to perform a predetermined operation by utilizing a combustion pressure, the combustion pressure being generated when the fuel is burned in the combustion chamber by the igniter, and a single actuator means for actuating the fuel supplier and the igniter, wherein in a first position of the actuator means, the auxiliary chamber receives a predetermined amount of the fuel from the fuel tank and stores the predetermined amount of the fuel in a pressurized state, and in a second position of the actuator means, the fuel is supplied from the auxiliary chamber into the combustion chamber and the igniter is actuated to perform ignition in response to and dependent upon changes in the pressure of the fuel within the auxiliary chamber as the fuel is supplied into the combustion chamber.

2. The combustion power tool as defined in claim 1, wherein the igniter performs ignition when the fuel pressure within the auxiliary chamber reaches about the same pressure as atmospheric pressure.

3. The combustion power tool as defined in claim 1, wherein a signal is detected when the fuel pressure within the auxiliary chamber is reduced to below a set value and wherein the igniter performs ignition after a predetermined time lapse when the signal is detected.

4. The combustion power tool as defined in claim 1, wherein the igniter performs ignition based on the pressure change within the combustion chamber as the fuel is supplied into the combustion chamber.

5. The combustion power tool as defined in claim 4, wherein a signal is detected when the fuel pressure within the combustion chamber exceeds a set value and wherein the igniter performs ignition when a predetermined time lapses after the signal is detected.

6. The combustion power tool as defined in claim 1 further comprising:

a first combustion chamber and a second combustion chamber into which the fuel is charged, an igniter disposed in the first combustion chamber, a partition that separates the first combustion chamber from the second combustion chamber, a plurality of communication holes, each hole formed in the partition to communicate the first combustion chamber with the second combustion chamber, a guide cylinder connected to the second combustion chamber, a piston slidably disposed within the guide cylinder, wherein the piston performs a predetermined operation by utilizing a combustion pressure, the combustion pressure being generated when the fuel in the first combustion chamber is burned by the igniter and when the burning front of the fuel in the first combustion chamber propagates to the second combustion chamber through the communication holes of the partition and burns the fuel in the second combustion chamber, and wherein the piston is retracted by utilizing a negative pressure caused by cooling and contracting action when the combustion gas within the first and the second combustion chambers is discharged to the outside and an inlet through which outside air is taken into the first combustion chamber by the negative pressure caused within the first and the second combustion chambers.

7. The combustion power tool as defined in claim 1 further comprising:

a first combustion chamber and a second combustion chamber into which the fuel is charged, an igniter disposed in the first combustion chamber, a partition that separates the first combustion chamber from the second combustion chamber, a plurality of communication holes, each hole formed in the partition to communicate the first combustion chamber with the second combustion chamber, a guide cylinder connected to the second combustion chamber, a piston slidably disposed within the guide cylinder, wherein the piston performs a predetermined operation by utilizing a combustion pressure, the combustion pressure being generated when the fuel in the first combustion chamber is burned by the igniter and when the burning front of the fuel in the first combustion chamber propagates to the second combustion chamber through the communication holes of the partition and burns the fuel in the second combustion chamber, and wherein the piston is retracted by utilizing a negative pressure caused by cooling and contracting action when the combustion gas within the first and the second combustion chambers is discharged to the outside and a slide sleeve that defines the circumferential wall of the second combustion chamber, the slide sleeve connecting and disconnecting the second chamber with the outside, wherein the slide sleeve comprises a wall surface that improves the burned gas flow when the slide sleeve moves to connect the second combustion chamber with the outside.

8. The combustion power tool as defined in claim 1, wherein the driving mechanism comprises a piston rod that linearly moves to strike a nail to the workpiece.

9. The combustion power tool as defined in claim 1, wherein the fuel supplier further comprises:

a valve coupled to the fuel tank, the auxiliary chamber, the combustion chamber and the single actuator means, wherein in the first position of the actuator means, the fuel the fuel is supplied from the fuel tank to the auxiliary chamber via the valve, and in the second position of the actuator means, the fuel is supplied from the auxiliary chamber into the combustion chamber via the valve.

10. A combustion power tool comprising:

a combustion chamber in which a fuel is burned, means for supplying the fuel into the combustion chamber, the means comprising a fuel tank, and an auxiliary chamber coupled to the fuel tank, an igniter disposed in the combustion chamber, a driving mechanism actuated to perform a predetermined operation by utilizing a combustion pressure, the combustion pressure being generated when the fuel is burned in the combustion chamber by the igniter, and a single actuator means for actuating the fuel supplying means and the igniter, wherein in a first position of the actuator means, the auxiliary chamber receives a predetermined amount of the fuel from the fuel tank and stores the predetermined amount of the fuel in a pressurized state, and in a second position of the actuator means, the fuel is supplied from the auxiliary chamber into the combustion chamber and the igniter is actuated to perform ignition in response to and dependent upon changes in the pressure of the fuel within the auxiliary chamber as the fuel is supplied into the combustion chamber.

11. A combustion power tool including:

a first combustion chamber and a second combustion chamber into which a fuel is charged, an igniter disposed in the first combustion chamber, a dome-shaped partition that separates the first combustion chamber from the second combustion chamber, a plurality of communication holes, each hole formed in the partition to communicate the first combustion chamber with the second combustion chamber, a guide cylinder connected to the second combustion chamber, a piston slidably disposed within the guide cylinder, wherein the piston performs a predetermined operation by utilizing a combustion pressure, the combustion pressure being generated when the fuel in the first combustion chamber is burned by the igniter and when the burning front of the fuel in the first combustion chamber propagates to the second combustion chamber through the communication holes of the partition and burns the fuel in the second combustion chamber, and wherein the piston is retracted by utilizing a negative pressure caused by cooling and contracting action when the combustion gas within the first and the second combustion chambers is discharged to the outside, an inlet through which outside air is taken into the first combustion chamber by the negative pressure caused within the first and the second combustion chambers, a fuel supplier comprising a fuel tank and an auxiliary chamber coupled to the fuel tank, and an actuator means for operating the fuel supplier and the igniter in one operation, wherein in a first position of the actuator means, the auxiliary chamber receives a predetermined amount of the fuel from the fuel tank and stores the predetermined amount of the fuel in a pressurized state, and in a second position of the actuator means, the fuel is supplied from the auxiliary chamber into the combustion chamber via the fuel supplier and the igniter performs ignition in response to and dependent upon changes in the pressure of the fuel within the auxiliary chamber as the fuel is supplied into the combustion chamber.

12. A combustion power tool including:

a first combustion chamber and a second combustion chamber into which a fuel is charged, an igniter disposed in the first combustion chamber, a dome-shaped partition that separates the first combustion chamber from the second combustion chamber, a plurality of communication holes, each hole formed in the partition to communicate the first combustion chamber with the second combustion chamber, a guide cylinder connected to the second combustion chamber, a piston slidably disposed within the guide cylinder, wherein the piston performs a predetermined operation by utilizing a combustion pressure, the combustion pressure being generated when the fuel in the first combustion chamber is burned by the igniter and when the burning front of the fuel in the first combustion chamber propagates to the second combustion chamber through the communication holes of the partition and burns the fuel in the second combustion chamber, and wherein the piston is retracted by utilizing a negative pressure caused by cooling and contracting action when the combustion gas within the first and the second combustion chambers is discharged to the outside, a slide sleeve that defines the circumferential wall of the second combustion chamber, the slide sleeve connecting and disconnecting the second combustion chamber with the outside, wherein the slide sleeve comprises a wall surface that improves the burned gas flow when the slide sleeve moves to connect the second combustion chamber with the outside, a fuel supplier comprising a fuel tank and an auxiliary chamber coupled to the fuel tank, and an actuator means for operating the fuel supplier and the igniter in one operation, wherein in a first position of the actuator means, the auxiliary chamber receives a predetermined amount of the fuel from the fuel tank and stores the predetermined amount of the fuel in a pressurized state, and in a second position of the actuator means, the fuel is supplied from the auxiliary chamber into the combustion chamber via the fuel supplier and the igniter performs ignition in response to and dependent upon changes in the pressure of the fuel within the auxiliary chamber as the fuel is supplied into the combustion chamber.

* * * * *